US010421305B2

(12) United States Patent
McMurrin et al.

(10) Patent No.: US 10,421,305 B2
(45) Date of Patent: Sep. 24, 2019

(54) FEED-THROUGH THERMAL PRESSING SYSTEM AND ASSOCIATED COMPONENTS

(71) Applicants: Chums, Inc., Salt Lake City, UT (US); Production Assembly Corporation, Centennial Park, AZ (US)

(72) Inventors: Sterling McMurrin, Bountiful, UT (US); Lorin Zitting, Centennial Park, AZ (US)

(73) Assignees: Chums, Inc., Salt Lake City, UT (US); Production Assembly Corporation, Centennial Park, AZ (US)

( * ) Notice: Subject to any disclaimer, the term of this patent is extended or adjusted under 35 U.S.C. 154(b) by 0 days.

(21) Appl. No.: 14/719,175

(22) Filed: May 21, 2015

(65) Prior Publication Data

US 2016/0339728 A1 Nov. 24, 2016

(51) Int. Cl.

| | |
|---|---|
| ***B41M 5/382*** | (2006.01) |
| ***B41M 5/035*** | (2006.01) |
| ***B41F 16/00*** | (2006.01) |

(52) U.S. Cl.

CPC ..... *B41M 5/38221* (2013.01); *B41F 16/0006* (2013.01); *B41M 5/0358* (2013.01)

(58) Field of Classification Search

None

See application file for complete search history.

(56) References Cited

U.S. PATENT DOCUMENTS

| | | | | |
|---|---|---|---|---|
| 4,462,704 | A * | 7/1984 | Kurata | B41J 2/35 347/191 |
| 4,723,484 | A * | 2/1988 | Held | B30B 5/062 100/154 |
| 5,094,308 | A * | 3/1992 | De Brock | B30B 5/04 100/151 |
| 5,352,321 | A * | 10/1994 | Held | B27D 1/02 100/154 |
| 5,539,498 | A * | 7/1996 | De Cock | G03G 15/1695 355/30 |
| 5,558,016 | A * | 9/1996 | De Brock | B30B 5/062 100/151 |
| 6,130,408 | A * | 10/2000 | Fukuda | G03G 15/2007 219/216 |
| 6,908,295 | B2 * | 6/2005 | Thielman | B23K 26/26 425/371 |

(Continued)

*Primary Examiner* — Alejandro Valencia

(74) *Attorney, Agent, or Firm* — Stoel Rives LLP

(57) ABSTRACT

Systems and methods are provided for thermal sublimation imaging and more generally thermal pressing through a continuous or intermittent feed-through thermal pressing system. Cutting assemblies may be configured to cut, connect, advance, and/or align transfer media. The transfer media may have images created using inks, dyes, or the like that are configured to be sublimated into a substrate material within a sublimation assembly. The substrate may be interposed between upper and lower transfer media to allow for dual-side imaging via thermal sublimation. A thermal sublimation chamber may include a pre-confinement zone to reduce ghosting, a preheat zone, a thermal saturation zone to effectuate sublimation and image transfer, and/or a post-sublimation cooling zone to reduce ghosting. A post-sublimation collection system may separate transfer media from substrate(s).

20 Claims, 22 Drawing Sheets

(56) References Cited

U.S. PATENT DOCUMENTS

| | | | | |
|---|---|---|---|---|
| 7,595,909 | B2 * | 9/2009 | Clark | B41M 5/0358<br>347/171 |
| 2005/0056392 | A1 * | 3/2005 | Anderson | D21G 7/00<br>162/199 |

* cited by examiner

FEED-THROUGH THERMAL PRESSING SYSTEM AND ASSOCIATED COMPONENTS

TECHNICAL FIELD

This disclosure relates to systems and methods associated with continuous-feed thermal pressing systems and apparatuses. One particular embodiment of this disclosure relates to thermal dye sublimation for image transfer and includes components for pre-sublimation alignment, sublimation, post-sublimation cooling, and post-printing collection.

BRIEF DESCRIPTION OF THE DRAWINGS

This disclosure describes numerous embodiments that are non-limiting and non-exhaustive. Reference is made throughout the disclosure to various illustrative embodiments that are depicted in the figures described below.

Figure 1:
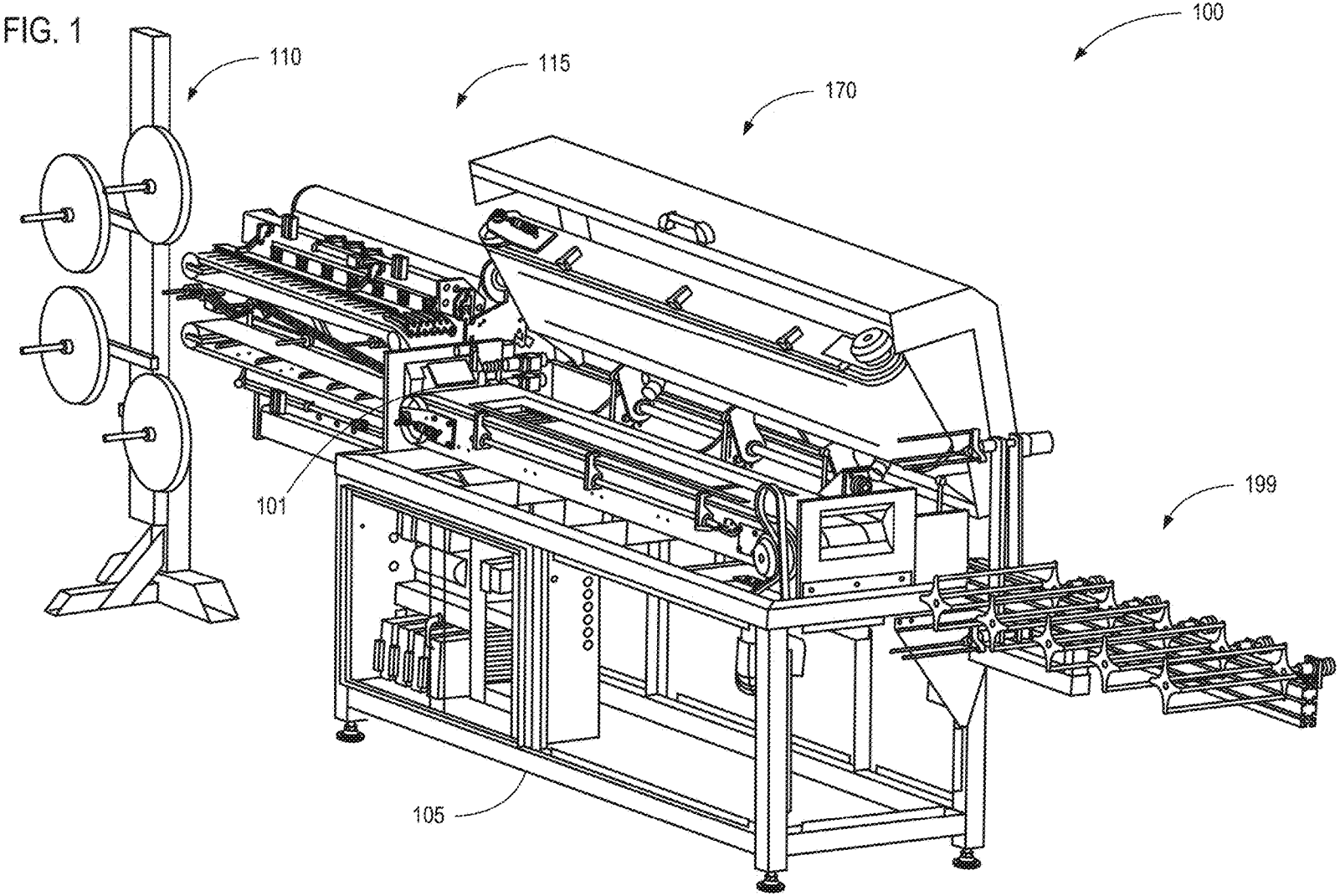
FIG. 1 illustrates a thermal pressing system, including a substrate feed system, a transfer medium cutting and alignment system, a pre-press media confinement subsystem, an environmentally controlled sublimation chamber, and a post-processing media collection system, according to various embodiments.

References to the figures throughout the description are for convenience only. Embodiments of the devices, systems, and methods described herein may include one or more additional components or features not illustrated in the figures. Similarly, one or more of the illustrated components or features may be omitted and/or substituted for a different component or feature in any of the embodiments described herein. Furthermore, the described features, structures, or characteristics may be combined in any suitable manner in one or more alternative embodiments.

DETAILED DESCRIPTION

Much of the infrastructure that can be used according to the present invention is already available, such as electric motors, pneumatic controls and systems, vacuums, general-purpose computers, computer programming tools and techniques, computer networks and networking technologies, digital storage media, authentication, access control, pneumatic devices, and mechanical apparatuses such as pulleys, gears, belts, cutting tools, spooling wheels, and the like.

Some of the steps, methods, environmental variables, speeds, temperatures, and other components of the mechanical systems disclosed herein may be controlled by a computer system. Accordingly, various aspects of the present disclosure may be embodied in machine-executable instructions to be executed by a computer system to control the mechanical systems described herein. A computer system may include one or more general-purpose or special-purpose computers (or other electronic devices). The computer system may include hardware components that include specific logic for performing the steps or may include a combination of hardware, software, and/or firmware.

The embodiments of the disclosure are described below with reference to the drawings, wherein like parts are designated by like numerals throughout. The components of the disclosed embodiments, as generally described and illustrated in the figures herein, could be arranged and designed in a wide variety of different configurations. Furthermore, the features, structures, and operations associated with one embodiment may be applicable to or combined with the features, structures, or operations described in conjunction with another embodiment. In other instances, well-known structures, materials, or operations are not shown or described in detail to avoid obscuring aspects of this disclosure.

Thus, the following detailed description of the embodiments of the systems and methods of the disclosure is not intended to limit the scope of the disclosure, as claimed, but is merely representative of possible embodiments. Each element of each embodiment may be combined with one or more of the elements described in conjunction with one or more other embodiments. In addition, the steps of a method do not necessarily need to be executed in any specific order, or even sequentially, nor do the steps need to be executed only once. Sub-systems and sub-components of the presently described systems and methods are also contemplated for use in other applications and are thus envisioned as stand-alone embodiments for incorporation into other systems not described herein.

Many of the illustrated embodiments depict adaptations for continuous- or intermittent-feed pressing apparatuses and associated components that have been adapted or configured for thermal sublimation image transfers. However, it is appreciated that the presently described thermal pressing apparatus and associated components can be configured for use with and/or adapted to be used for direct printing, thermal transfers, laminating, fusing, curing, pleating, pressing, and/or the like. Thus, descriptions and illustrations tending to describe or illustrate image transfer and particularly dye-sublimation embodiments are merely provided by way of example.

FIG. 1 illustrates an embodiment of a continuous-feed thermal pressing system 100 configured for thermal sublimation. The continuous-feed thermal pressing system 100 includes a substrate feed system 110, a transfer medium cutting and alignment system 115, a pre-press media confinement subsystem 101, an environmentally controlled pressing chamber 170, and a post-pressing media collection system 199, according to various embodiments.

In embodiments in which the continuous-feed thermal pressing system is configured as a dye-sublimation imaging system, the substrate feed system 110 and the transfer medium cutting and alignment system 115 may be particularly adapted to handle materials useful for thermal dye sublimation. The pre-press media confinement subsystem 101 may be referred to as a pre-sublimation media confinement subsystem. Similarly, the post-processing media collection system 100 may be referred to as a post-sublimation media collection system and the pressing chamber 170 may be referred to as a sublimation chamber. As such, any reference herein to the embodiments adapted for sublimation and image transfer should be understood as examples of possible uses of a continuous-feed (or intermittent-feed) thermal pressing system.

Reference is now made to the illustrated embodiment of the thermal pressing system as a "sublimation imaging system." As illustrated, one or more portions of the sublimation imaging system 100 may be supported by a stand 105. Stand 105 may, in some embodiments, house control systems, computers, pneumatic systems, vacuum systems, electrical equipment, power conditioning equipment, fans, and/or other auxiliary or supply systems. Such supply and auxiliary systems are not illustrated or described in detail herein to avoid obscuring other aspects of the sublimation imaging system 100. Moreover, the supply and/or auxiliary systems may be varied, combined, omitted, and/or otherwise modified based on a particular application or installation.

In the illustrated embodiment, the substrate feed system 110 includes four spools for delivering relatively long lengths of a narrow substrate. Each spool may deliver substrate concurrently, such that four relatively narrow lengths of substrate are concurrently advanced through the environmentally controlled sublimation chamber 170. Alternatively, the spools may deliver the substrate sequentially as each spool is exhausted. Any number of spools may be utilized. The spools may be omitted in some embodiments. For example, the substrate may be fed from a different supply source or manually fed, or the substrate may even be delivered from a storage container.

The maximum and minimum widths of the substrate that may be delivered may depend on the dimensions and configurations of other portions of the sublimation imaging system 100. For example, in various embodiments the substrate width may be limited by the width of the environmentally controlled sublimation chamber 170. In some embodiments, a substrate material that is wider than the environmentally controlled sublimation chamber 170 may be processed using multiple passes.

Additional details of various embodiments of the components and subsystems of the sublimation imaging system 100 are described below with reference to the remaining figures. It is appreciated that each of the components and subsystems may be utilized for its standalone function and/or in conjunction with other imaging systems, manufacturing systems, distribution systems, processing systems, and/or assemblies. For instance, the various embodiments of the transfer medium cutting and alignment system 115 described herein may be utilized independently (e.g., independent of the environmentally controlled sublimation chamber 170).

Figure 2:
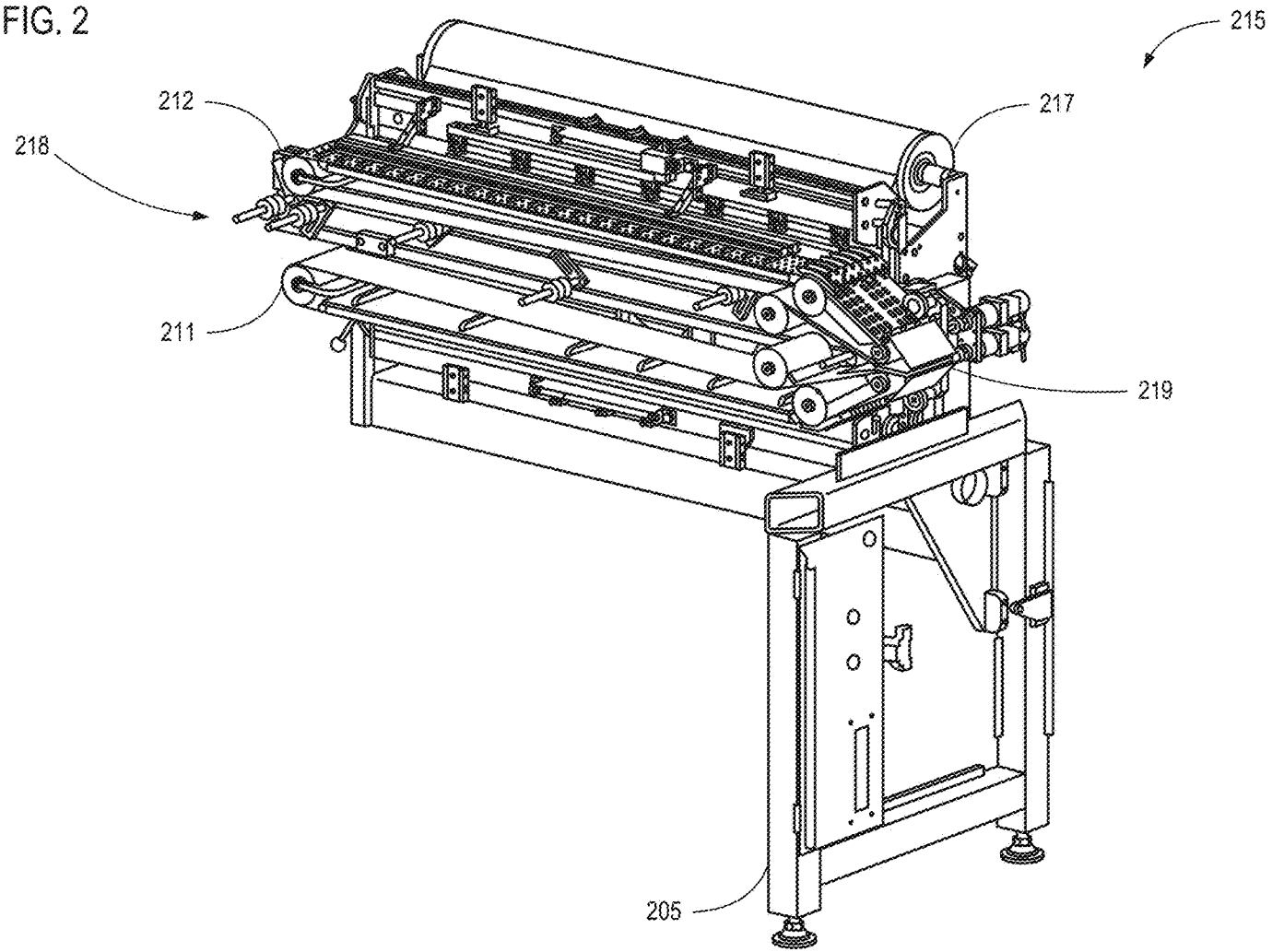
FIG. 2 illustrates a perspective front view of a transfer medium cutting and alignment system, according to various embodiments.

FIG. 2 illustrates a perspective front view of a transfer medium cutting and alignment system 215, according to various embodiments. As illustrated, the transfer medium cutting and alignment system 215 may include complementary (e.g., similar or identical) upper 212 and lower 211 assemblies.

Each of the upper 212 and lower 211 assemblies of the transfer medium cutting and alignment system 215 may include a transfer medium source 217 that can selectively supply a transfer medium to a cutting mechanism (described in detail below). The transfer medium may be cut into elongated strips and advanced through an alignment assembly 219.

The strips of cut transfer media may be joined together (e.g., via an adhesive, fastener, crimp, fold, friction, or the like) to form a continuous elongated length of transfer medium. The alignment assembly 219 may align an upper elongated length of transfer medium from the upper assembly 212 with a lower elongated length of transfer medium from the lower assembly 211 and interpose a substrate therebetween.

In the illustrated embodiment, the substrate is fed in between the upper 212 and lower 211 assemblies on a series of pulleys 218. For wider substrates, the pulleys 218 may be wider and/or replaced with another guide more suitable for a wide substrate, such as a belt or other feed mechanism.

In embodiments adapted for thermal sublimation, the transfer media may be adjusted or chosen for its sublimating properties. In other embodiments, the transfer medium may facilitate thermal transfers, laminating, fusing, curing, pleating and/or other processes involving thermal pressing in a continuous-intermittent-feed system. For example, the upper transfer medium may comprise an upper laminating medium and the lower transfer medium may comprise a lower laminating medium. In such an embodiments, a substrate may be thermally laminated by the thermal pressing system between the upper and lower laminating mediums.

As such, the term "transfer medium" should be broadly construed to encompass mediums used for transferring images in thermal sublimation imaging systems as well as other sheet or strip materials used in other processes such as laminating and fusing. FIGS. 3A-7 provide examples of a transfer medium cutting and alignment system 315-715 described with reference to transfer mediums for thermal sublimation image transfers. However, it is appreciated that any sheet material may be processed into strips in a continuous- or intermittent-feed thermal pressing system.

Figure 3A:
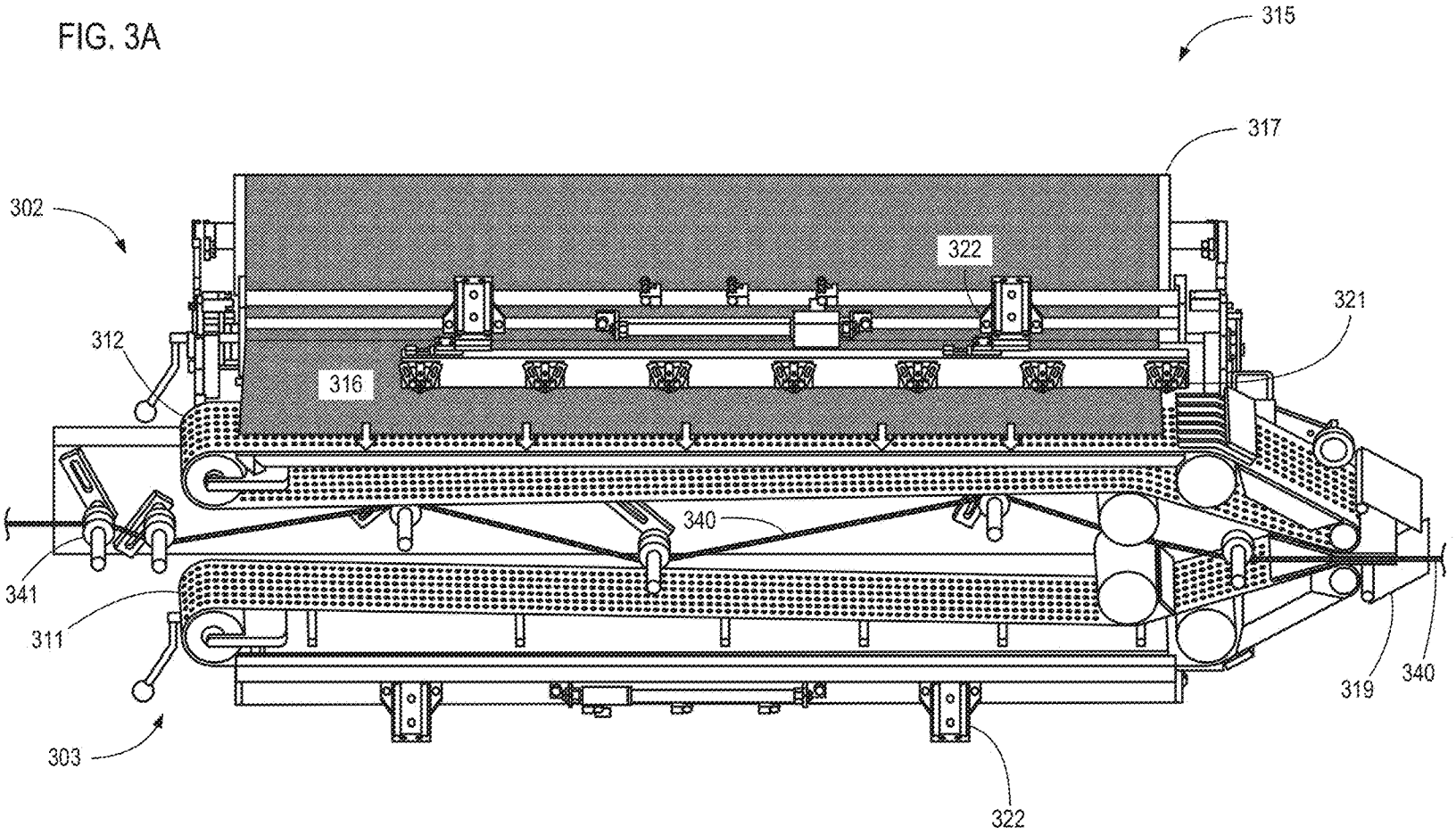
FIG. 3A illustrates a top perspective view of a transfer medium cutting and alignment system with a transfer medium being moved into place prior to being cut, according to various embodiments.

FIG. 3A illustrates a top perspective view of a transfer medium cutting and alignment system 315 with a transfer medium 316 being moved into place prior to being cut, according to various embodiments. As illustrated, an upper assembly 302 and a lower assembly 303 may include complementary components and effectively function as mirror images of one another. In some embodiments, a single-sided sublimation transfer device may include only an upper assembly 302 or only a lower assembly 303.

The top view of FIG. 3A obscures some of the components of the lower assembly 303, so reference is made primarily to the upper assembly 302. As illustrated, each assembly 302 and 303 includes a transfer medium advancing belt 312 (upper) and 311 (lower). The transfer medium advancing belts 312 and 311 may include a plurality of holes configured to selectively exert a vacuum suction to temporarily secure the transfer medium 316 to the belt 312, 311.

As illustrated, a substrate 340 may be advanced between the upper and lower assemblies 302 and 303 along a series of pulleys 341 through the alignment assembly 319. In the illustrated embodiment, the substrate 340 is a relatively thin material. However, it is appreciated that a wide variety of substrates may be utilized, including those having various widths, depths, and lengths, depending on the dimensions of the other components of a thermal sublimation imaging system.

Upper assembly 302 is illustrated as including a spool 317 of transfer medium 316 to feed across the belt 312. FIG. 3A illustrates the transfer medium 316 being advanced across the belt 312. In various embodiments, the vacuum suction provided via the holes in the belt 312 may be reduced and/or turned off as the transfer medium 316 is advanced across the belt 312. The cutting assembly 322 and each of its associated blades 321 may be disengaged while the transfer medium 316 is advanced across the belt 312.

Figure 3B:
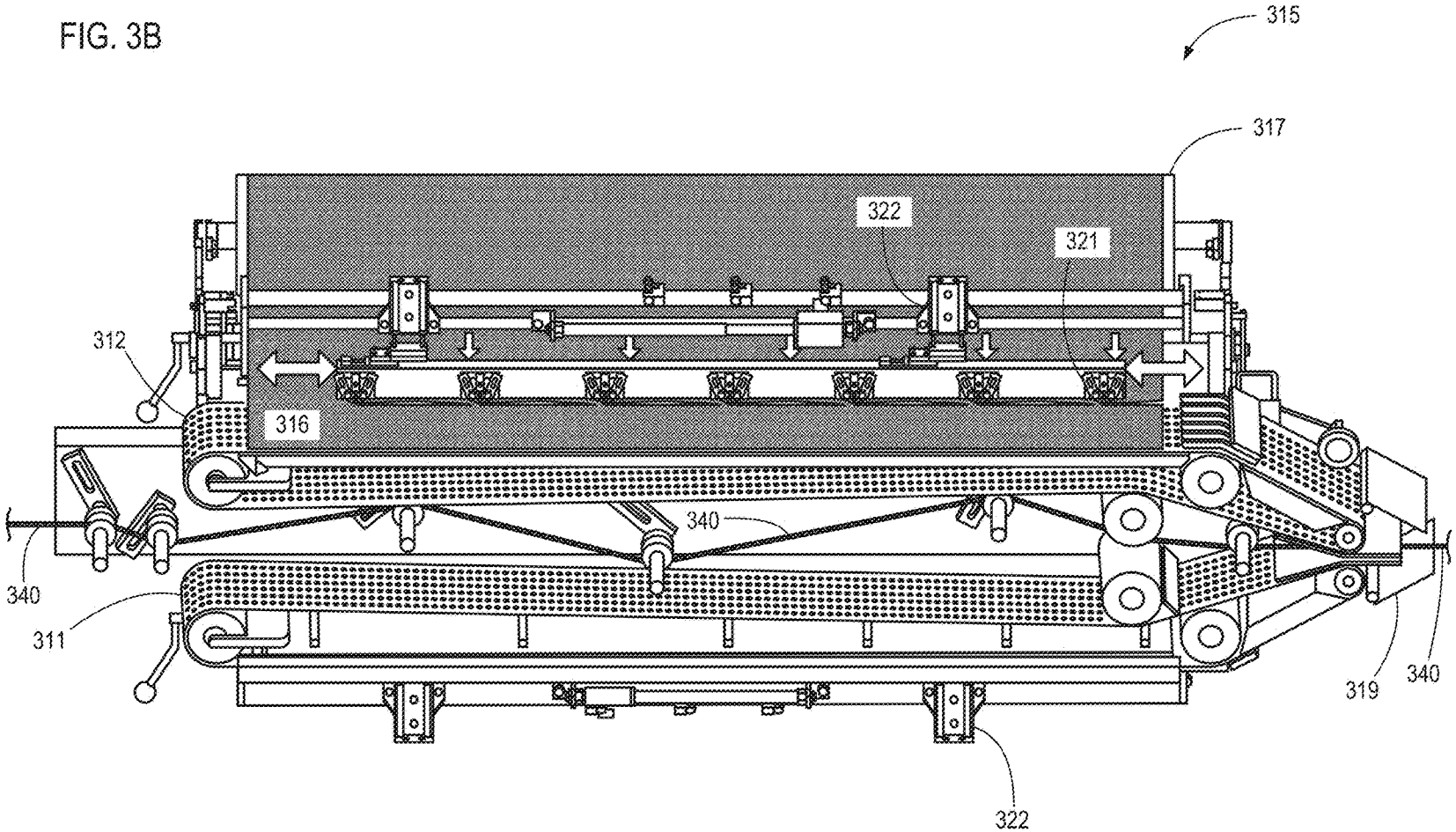
FIG. 3B illustrates the top perspective view of the transfer medium cutting and alignment system of FIG. 3A with the transfer medium being cut, according to various embodiments.

FIG. 3B illustrates the top perspective view of the transfer medium cutting and alignment system 315 of FIG. 3A with the transfer medium 316 being cut, according to various embodiments. The blades 321 of the cutting assembly 322 are illustrated as cutting transfer medium 316 into an elongated strip atop the belt 312. In the illustrated embodiment, cutting assembly 322 includes seven blades 321 such that the cutting assembly 322 need only move the separation distance of each of the blades 321. In other embodiments, a single blade (or more or fewer blades) may travel the length of the transfer medium 316.

In various embodiments, the holes in the belt 312 may exert a vacuum force on the transfer medium 316 during the cutting process to minimize movement during cutting. The vacuum may continue to exert a force as the transfer medium 316 is then advanced by the belt 312 to the alignment assembly 319.

Figure 4:
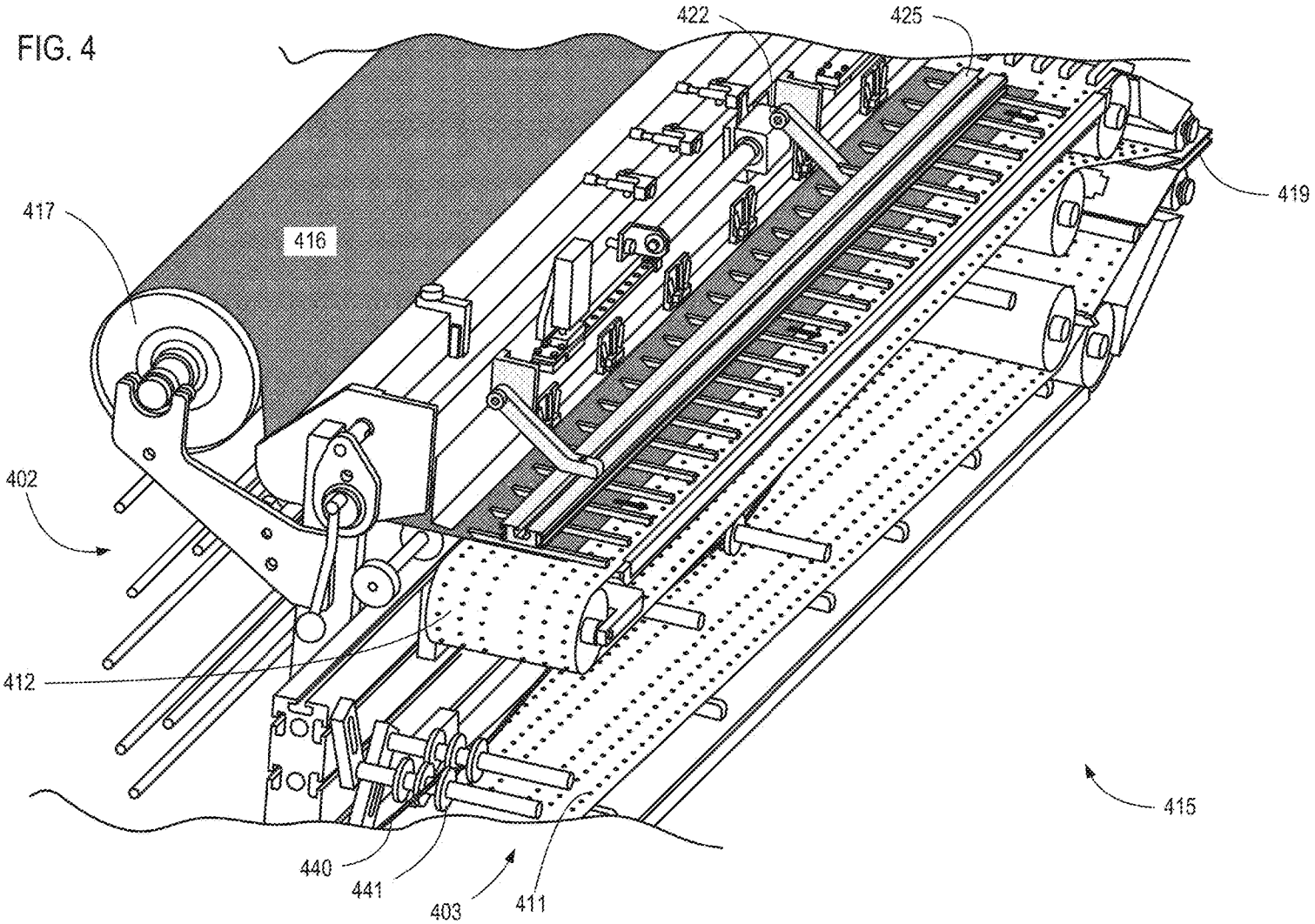
FIG. 4 illustrates a top perspective view of a transfer medium cutting and alignment system with a transfer medium being moved into place beneath a guard rail, according to various embodiments.

FIG. 4 illustrates another view of a transfer medium cutting and alignment system 415 with a transfer medium 416 being fed from a roll 417 onto a belt 412 with vacuum holes, as described herein. The illustrated embodiment includes a guardrail 425 positioned above the advancing transfer medium 416. In some embodiments, the guardrail 425 may contact the upper surface of the transfer medium 416. In other embodiments, the guardrail 425 may be positioned above, but not in contact with, the transfer medium 416 when the transfer medium 416 is resting against the belt 412.

In some embodiments, the guardrail 425 may serve to guide the transfer medium 416 as it is advanced onto the belt 412. For instance, the guardrail 425 may prevent the transfer medium 416 from curling as it is advanced onto the belt 412. The guardrail 425 may also ensure that the transfer medium 416 will be pulled against the belt 412 when the vacuum suction is applied via the holes in the belt 412.

Once the transfer medium 416 is in place, suction may be applied via the holes in the belt 412 to maintain the transfer medium 416 in a fixed position. The cutting assembly 422 may be used to cut the transfer medium 416 along the long axis of the transfer medium cutting and alignment system 415. The cut strip of transfer medium 416 may then be advanced to the alignment assembly 419.

The preceding description of FIG. 4 referred primarily to the functionality of the upper assembly 402 of the transfer medium cutting and alignment system 415 for the cutting of an upper transfer medium 416. A lower assembly 403 may include corresponding components and function similarly to advance and cut a lower transfer medium (not visible through lower belt 411). A substrate 440 may be advanced along pulley system 441. Alignment assembly 419 may interpose the substrate 440 between the upper transfer medium 416 and the lower transfer medium advanced by lower belt 411.

Figure 5A:
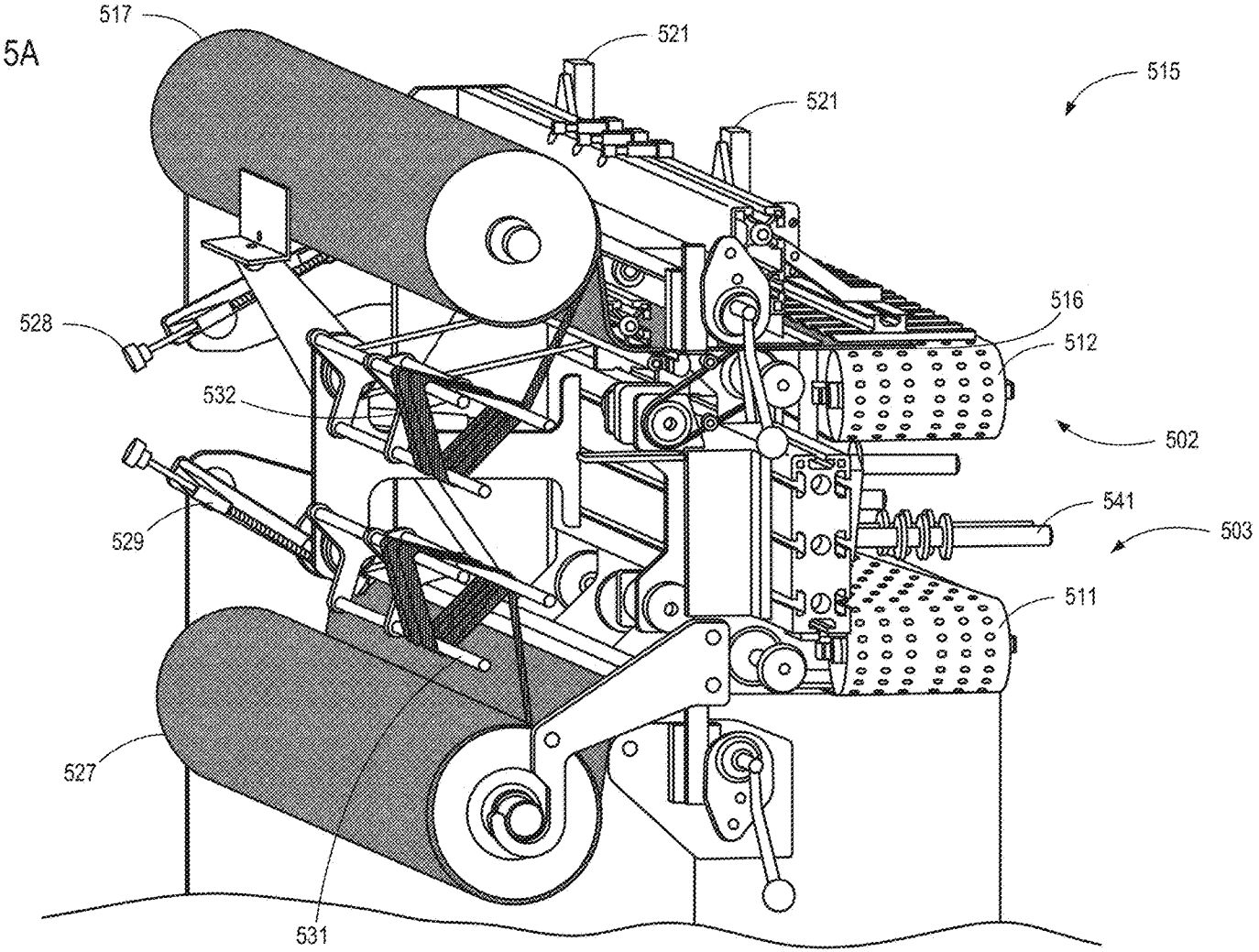
FIG. 5A illustrates a rear perspective view of a transfer medium cutting and alignment system showing a roll system for the transfer medium, according to one embodiment.

FIG. 5A illustrates a rear perspective view of one embodiment of a transfer medium cutting and alignment system 515 showing two rolled supplies of transfer media 516: an upper supply 517 and a lower supply 527. The upper supply 517 provides transfer media to the upper assembly 502, and the lower supply 527 provides transfer media to the lower assembly 503. The transfer media 516 may be pre-printed or otherwise imaged with an ink, dye, paint, stain, or the like that can be thermally transferred via sublimation to a substrate material, such as a polyester-based cloth. More generally, heat and/or pressure may be used to induce a thermal reaction for thermally pressing a substrate material. Transfer media, or more generally upper and lower media, may be used to facilitate the thermal pressing (e.g., a thermally transferred image such as via an aqueous ink with a cotton substrate, curing, fusing, drying, etc.) or be a part of the thermal pressing (e.g., as upper and lower laminate layers or as layers to be fused to the substrate).

The pre-printed transfer media 516 may be printed using a printer that cannot print edge to edge. Accordingly, it may be useful to cut and collect the unprinted margins of the transfer media 516 using collectors 531 and 532. The unprinted margin edges may be cut off using a slitting knife that can be adjusted to accommodate different margin widths.

As described in detail herein, sections of transfer media 516 may be advanced onto belts 511 and 512, respectively. An upper cutting assembly 521 and a lower cutting assembly (not shown) may cut sections of the supplies 517 and 527 and then advance them along the long axis of the transfer medium cutting and alignment system 515. Sequential sections of the cut transfer media 516 may be connected together to form a continuous length of transfer media 516 passing through a sublimation assembly.

The sections of cut transfer media 516 may be joined using any of a wide variety of fastening devices and methods, including various adhesives, fasteners, crimps, folds, frictional surfaces, surface tensions, and/or other various adhesion approaches. In the illustrated embodiment, adhesive applicators 529 and 528 apply a layer of glue as the transfer media 516 is advanced onto the belts 511 and 512 from supplies 527 and 517, respectively.

In the illustrated embodiment, the leading edge of an advancing cut strip of transfer media 516 has glue applied to it. As it is advanced toward the alignment assembly, the leading, glued end of the transfer media 516 is adhesively secured by a predetermined overlap with the trailing end of the strip of transfer media 516 preceding it. Glued ends of each cut strip of transfer media 516 may be joined.

Figure 5B:
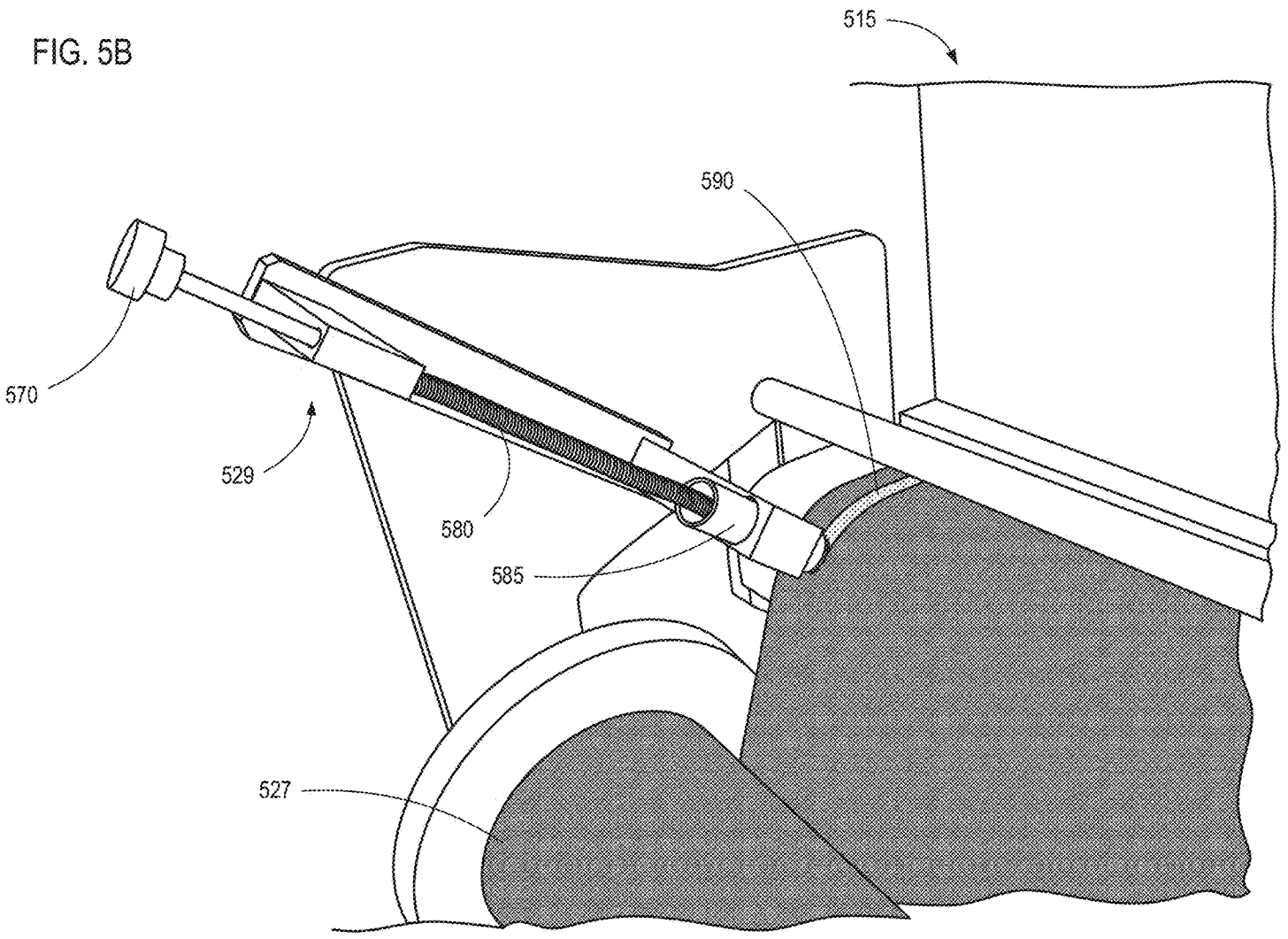
FIG. 5B illustrates an adhesive applicator used in combination with a transfer medium cutting and alignment system, according to one embodiment.

FIG. 5B illustrates a close-up view of one embodiment of an adhesive applicator. Specifically, FIG. 5B illustrates the lower adhesive applicator 529 of the transfer medium cutting and alignment system 515 shown in FIG. 5A. As illustrated, the adhesive applicator 529 may include a spring loaded 580 plunger 570 configured to apply an even layer of adhesive 590 near an edge of the transfer medium 516 from supply 527. An adhesive reservoir 585 may be configured to store a supply of adhesive and may be adapted in size or shape as needed. The illustrated embodiment shows an adhesive reservoir 585 configured to house glue from a standard glue stick. FIGS. 6A-6D illustrate some of the possible embodiments of cut strips being aligned and joined to one another as they are advanced toward a sublimation assembly with an interposed substrate.

Figure 6A:
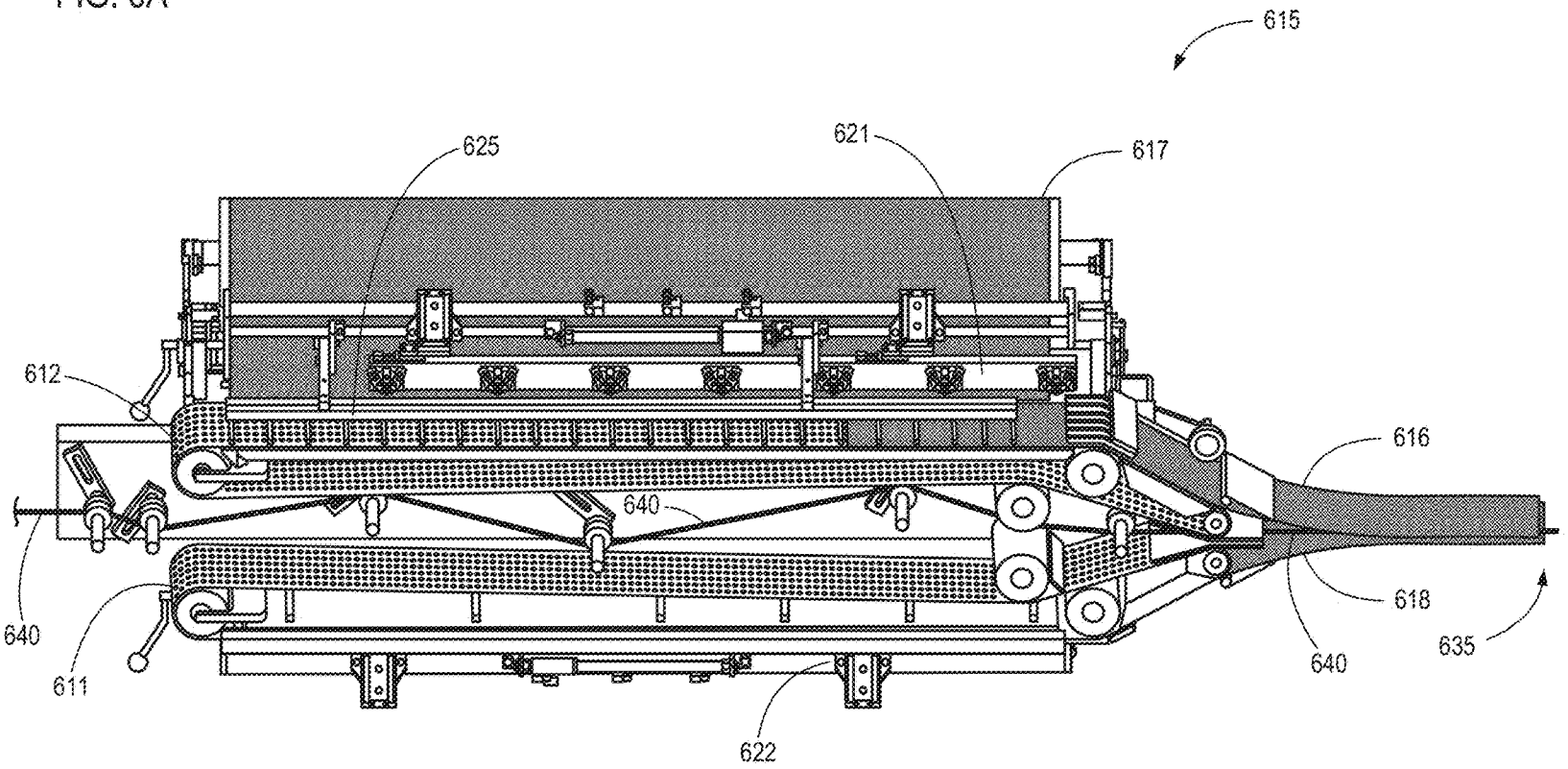
FIG. 6A illustrates a top perspective view of a transfer medium cutting and alignment system advancing cut sections of transfer media, according to one embodiment.

FIG. 6A illustrates a top perspective view of one embodiment of a transfer medium cutting and alignment system 615 advancing cut sections of an upper transfer medium 616 and a lower transfer medium 618. A substrate 640 is illustrated as being interposed, at 635, between the upper 616 and lower 618 transfer media. FIG. 6A shows the transfer media 616 and 618 already cut into strips by cutting assemblies 621 and 622. Once the transfer media 616 and 618 have been advanced by the belts 612 and 611 to clear the area beneath the guard 625, another section of transfer media will be unrolled from supply 617.

Figure 6B:
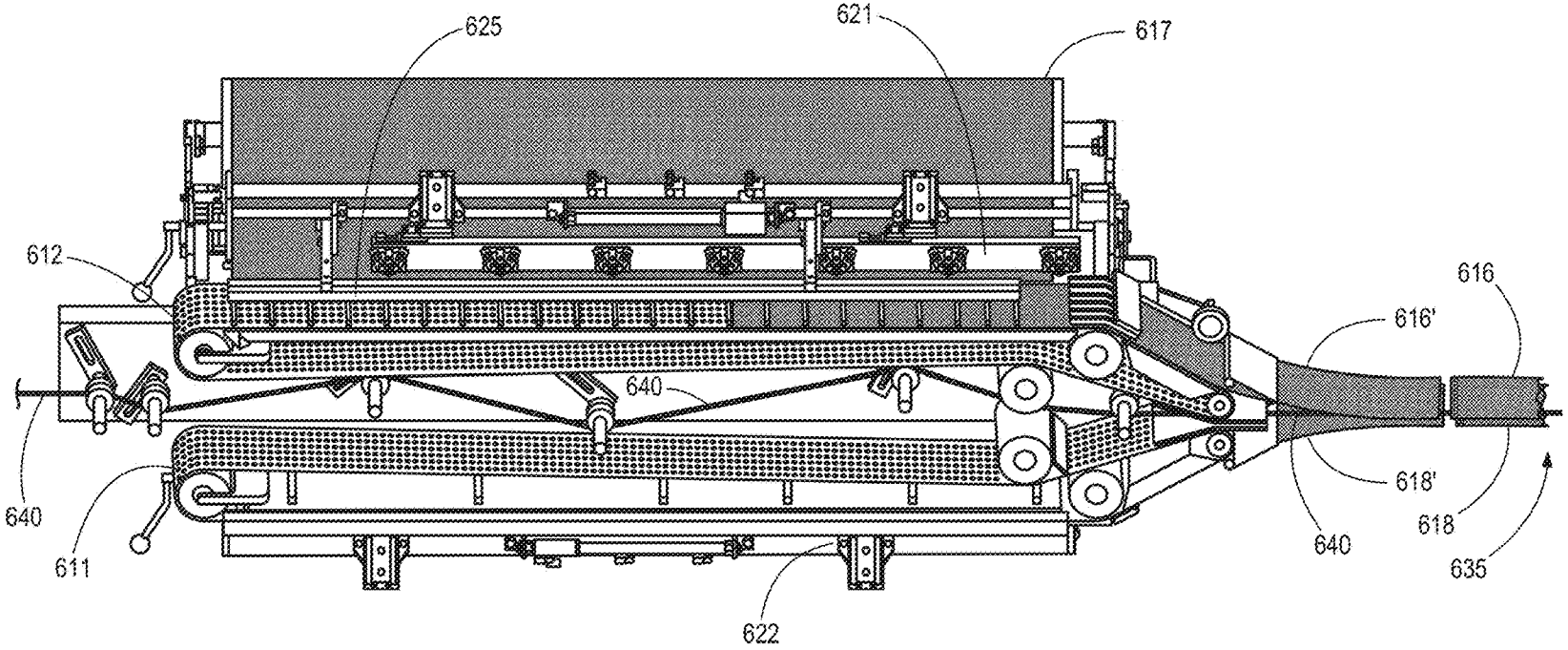
FIG. 6B illustrates sections of transfer media being advanced prior to being joined together, according to one embodiment.

FIG. 6B illustrates strips of the upper 616 and lower 618 transfer media having been advanced nearly to the edge of the drawing sheet such that only the trailing edges of the strips are shown. Additional cut strips of transfer media 616' and 618' are shown being advanced, such that continuous lengths of transfer media may be provided to a sublimation assembly with a substrate 640 interposed therebetween.

In the illustrated embodiment, a gap is shown between transfer media 616 and 618 and transfer media 616' and 618'. However, in various embodiments, the subsequent sections may be aligned with the preceding sections and/or be made to overlap and/or be joined with the preceding sections, as described herein.

Figure 6C:
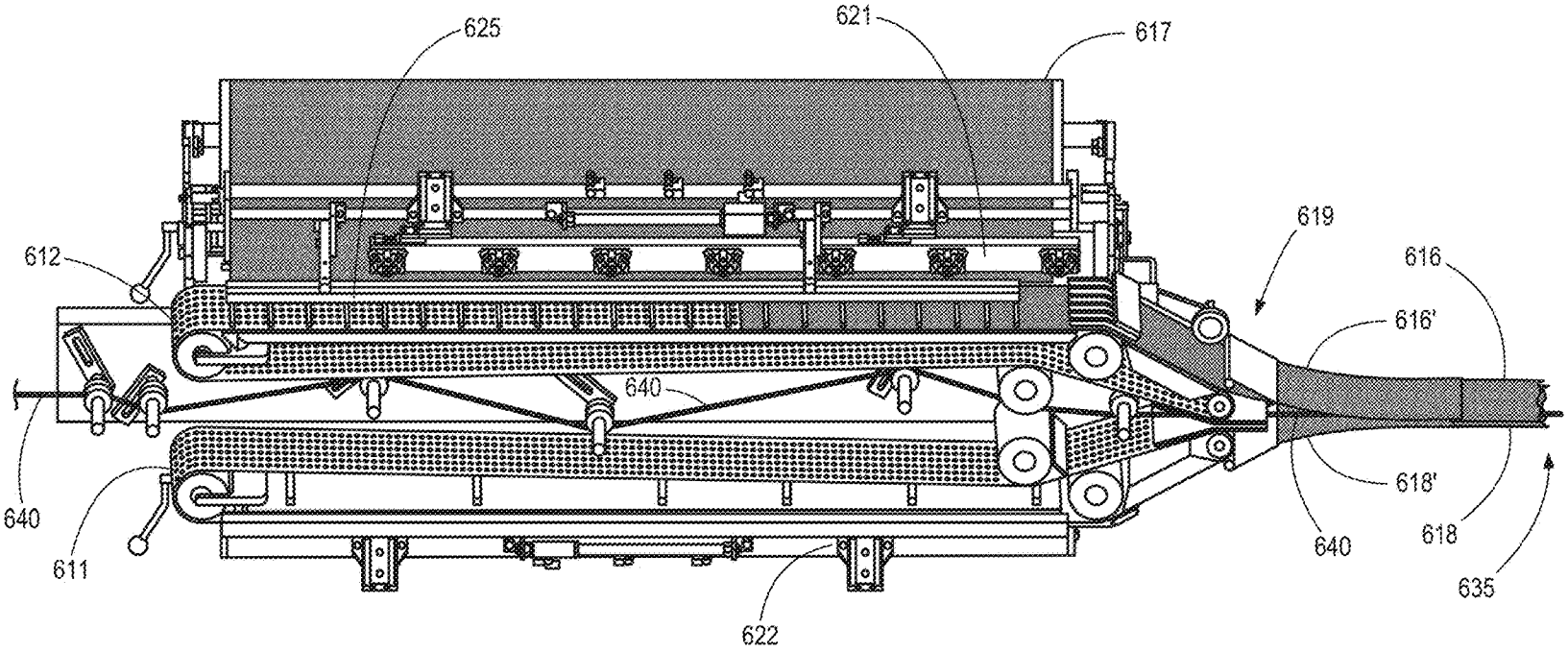
FIG. 6C illustrates sections of transfer media being overlapped and joined, according to one embodiment.

FIG. 6C illustrates one such embodiment in which the transfer media 616' and 618' are joined with and overlapping the transfer media 616 and 618. The exact location at which the sections are joined may vary based on design implementation. In some embodiments, the sections of transfer media 616 and 616' and 618 and 618' may be joined and/or be made to overlap after (to the right of) alignment assembly 619; in other embodiments, alignment assembly 619 may cause them to be joined and/or made to overlap as the substrate 640 is interposed therebetween.

Figure 6D:
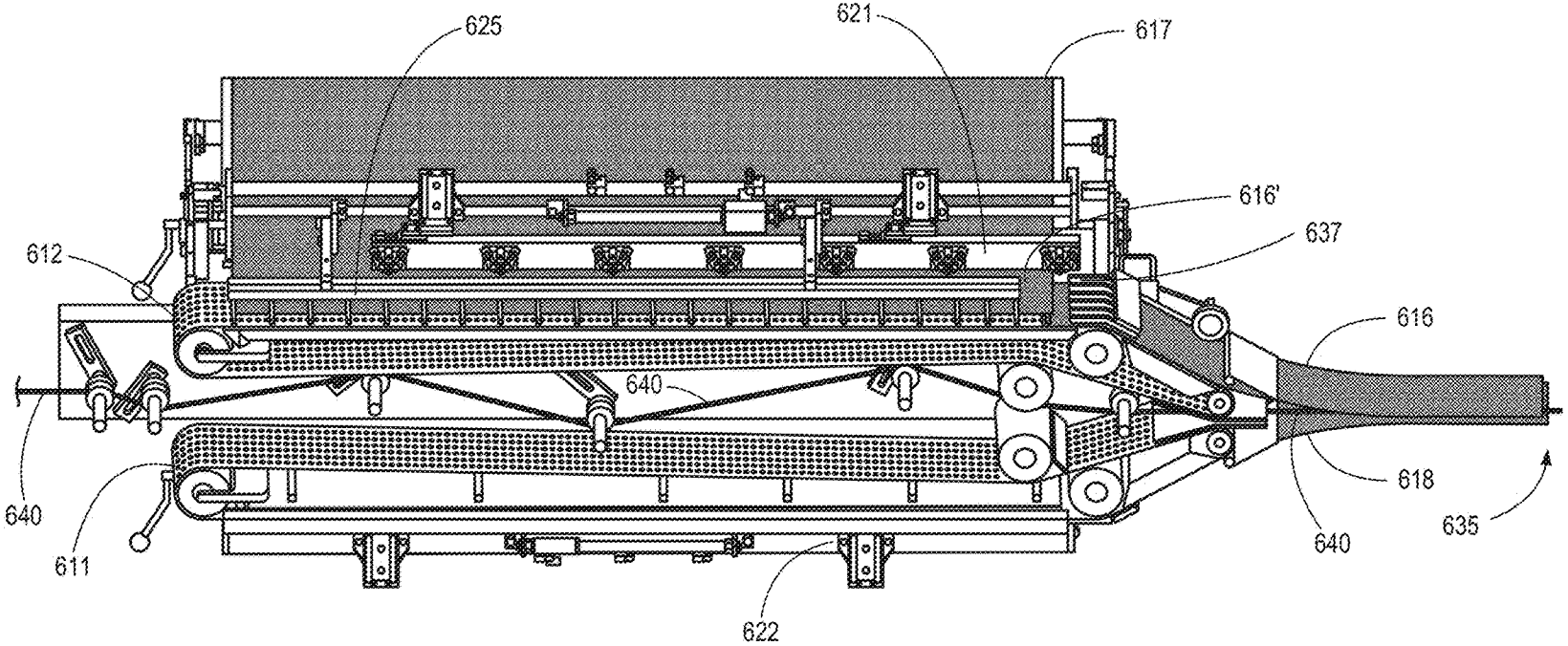
FIG. 6D illustrates sections of transfer media overlapping and joined prior to a substrate being interposed therebetween, according to one embodiment.

In still other embodiments, such as the embodiment illustrated in FIG. 6D, the transfer media may be made to overlap as a first section of transfer medium 616 is advanced by belt 612 and a subsequent section of transfer medium 616' is advanced into place from supply 617 beneath guard 625. A transfer medium attachment point 637 may facilitate the adhesion of one strip of transfer medium to the other.

Figure 7:
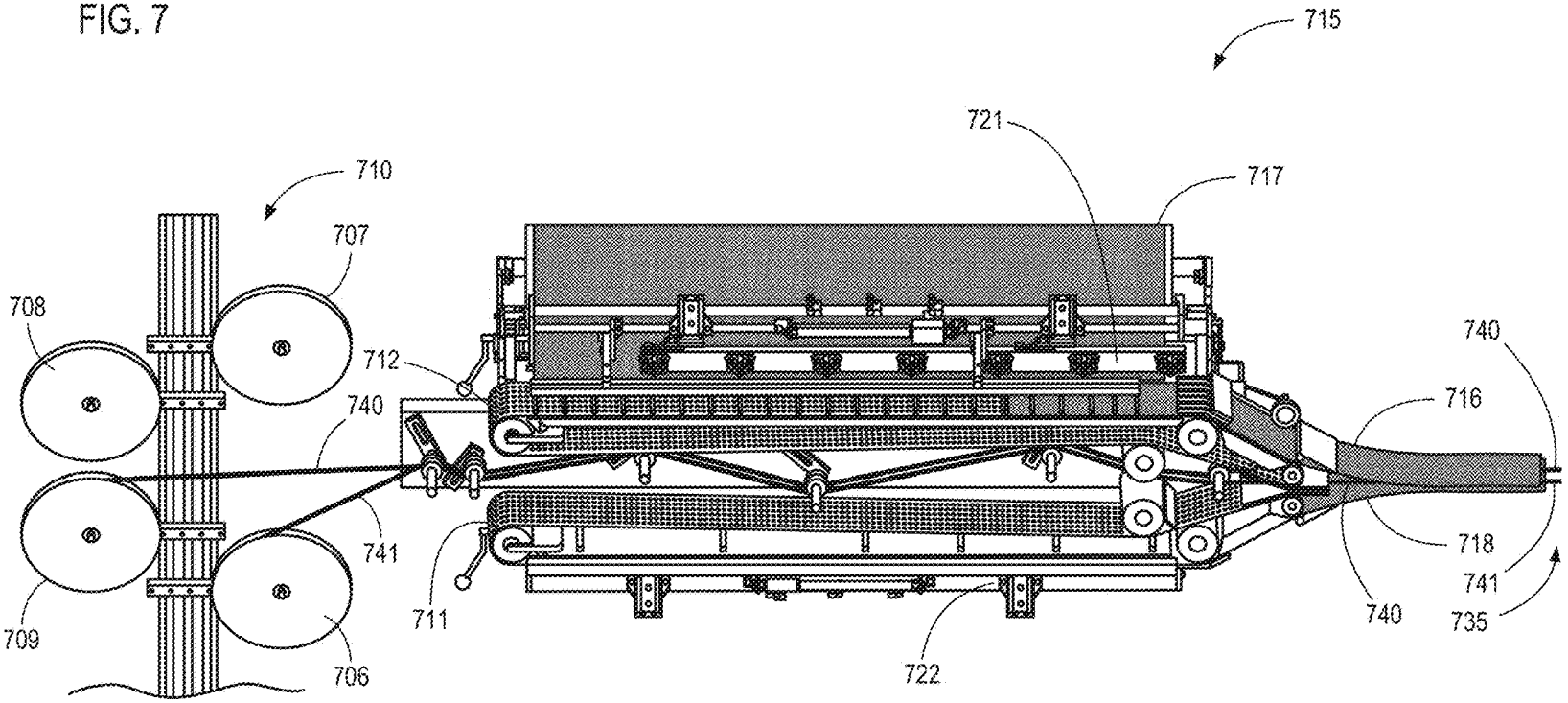
FIG. 7 illustrates a view of the substrate being unspooled from a feed system and aligned between upper and lower portions of cut transfer media, according to one embodiment.

FIG. 7 illustrates a view of a feed system 710 that includes four spools 706, 707, 708, and 709. Each spool 706-709 may be adapted in size, width, and/or capacity based on a chosen substrate. Relatively narrow substrates 740 and 741 are illustrated, but it is appreciated that wider substrates may be accommodated as well. Substrates 740 and 741 are fed between upper and lower belts 712 and 711 of a transfer medium cutting and alignment system 715. Cutting assemblies 721 and 722 work to cut strips of transfer media 716 and 718 as they are supplied by upper and lower supplies (upper supply 717 shown).

As illustrated, the two lengths of substrate 740 and 741 may be interposed, at 735, between upper and lower transfer media 716 and 718. Transfer media 716 and 718 may be printed with a repeating print such that both substrates 740 and 741 will be imaged (through sublimation) with the same image, or the transfer media 716 and 718 may be printed such that each cut section will include independent (e.g., different) prints for the two different substrates 740 and 741.

Moreover, in some embodiments, transfer media supply 717 may include a roll of one continuous image or pattern, while in other embodiments, the transfer media supply 717 may include a first portion with one print and one or more other sections with different prints. In such an embodiment, the system may continuously feed transfer media and substrate without interruption, even though the transferred image may be changed periodically based on the image currently being fed by the supply 717.

Figure 8:
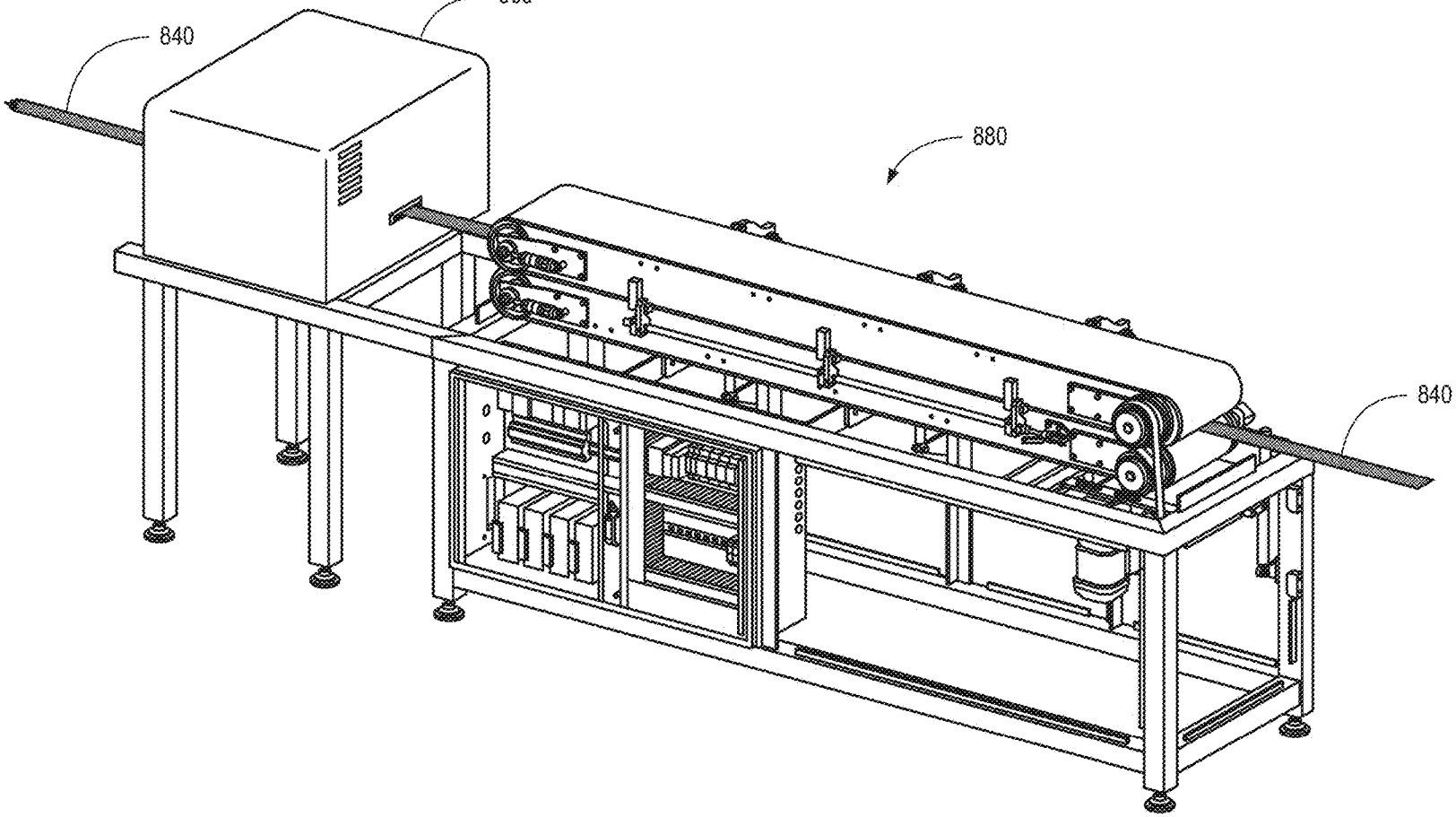
FIG. 8 illustrates a single feed-through embodiment in which at least a substrate is fed into a press assembly, according to one embodiment.

FIG. 8 illustrates an embodiment of the systems and methods described herein that omits a transfer medium cutting and alignment system. Instead, a substrate 840 is fed through a printing device 803 that transfers an image (e.g., as a dye, ink, paint, stain, etc.) directly onto one or both surfaces of the substrate 840. The printing device 803 may be in close proximity to the pressing assembly 880 and may feed the substrate 840 in real time. Alternatively, the printing device 803 may be separated from the pressing assembly 880, and the substrate 840 may be collected after printing and fed through the pressing assembly 880 at a later time. In some embodiments, the substrate may comprise a polyester material or polyester-coated material. In such embodiments, a thermally sublimating dye may be printed by printing device 803 onto or into substrate 840. In such embodiments, pressing assembly 880 may be considered a sublimation assembly.

The printing device 803 is configured to print the image or pattern on the substrate 840 using a dye or ink that can be thermally sublimated into the substrate within a sublimation assembly 880. The substrate 840 may, in various embodiments, include polyester or another material that accepts or at least partially accepts images transferred by thermal sublimation.

The printing device 803 may, in some embodiments, not be adapted for thermal sublimation image transfers. Rather, printing device 803 may print an aqueous ink or other non-sublimating dye that can be thermally pressed into or onto the substrate 840, after which the substrate 840 may be passed through press assembly 880 for a thermal pressing reaction where heat and/or pressure are applied.

In some embodiments, substrate 840 may comprise a belt, webbing, lanyard, or the like and printing device 803 may comprise one or more ink-jet print heads configured to print one or more sides of the substrate 840. The substrate may then be processed using heat and/or pressure within thermal press assembly 880 to cure the printed inks on the substrate 840. For example, printing device 803 may print a curable dye, ink, pigment, or the like on a belt, webbing, lanyard, shoe lace, backpack strap, seat belt, and/or the like. The curable dye, ink, pigment, or the like can then be cured, dried, hardened, sealed, and/or otherwise processed into a permanent or semi-permanent coloring via the thermal press assembly 880 through a pressure and/or thermal reaction.

Figure 9A:
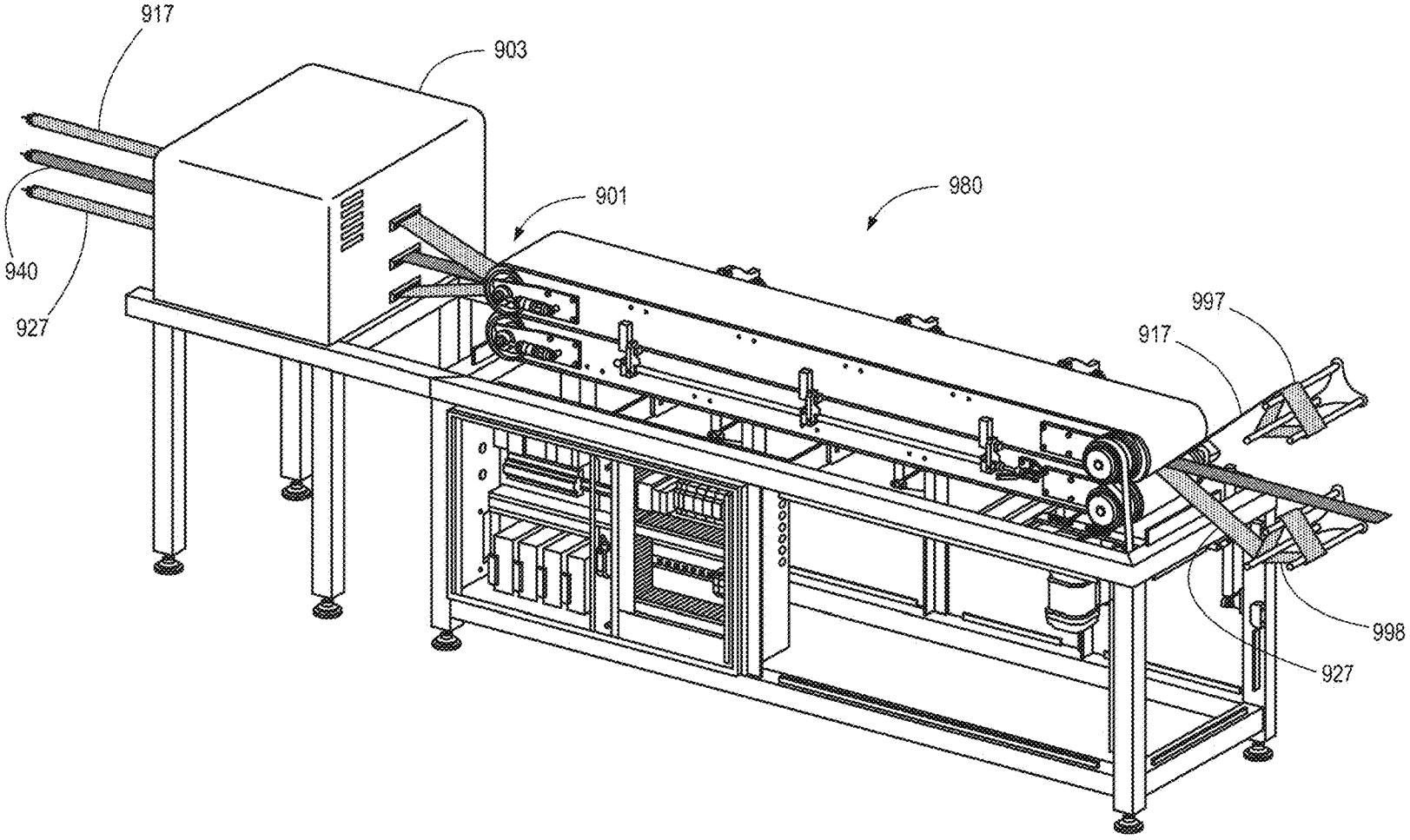
FIG. 9A illustrates an embodiment in which transfer media are printed in real time prior to the substrate being interposed between upper and lower transfer media.

FIG. 9A illustrates an alternative embodiment of a real-time imaging approach in which transfer media 917 and 927 are printed in real time via a printing device 903. The printing device 903 may pass the substrate 940 through without interaction and/or may apply a liquid and/or powder additive to aid in the thermal sublimation image transfer process. In some embodiments, an adhesive may be applied to one or more of the transfer media 917 and 927 and/or to the substrate 940. In some embodiments, printing device 903 may comprise an ink-jet printer or the like to print ink onto the substrate 940 directly and/or the transfer media 917 and 927

After the transfer media 917 and 927 have been imaged (or otherwise prepped for being pressed, laminated, pleated, cured, etc.), the substrate 940 may be interposed therebetween, at 901. As described below, a pre-confinement assembly or component may be configured to ensure the substrate is sufficiently interposed and inhibited from moving relative to the transfer media 917 and 927 prior to being heated within the press assembly 980.

With reference to thermal sublimation embodiments, once an image has been transferred via sublimation from the transfer media 917 and 927 within the sublimation assembly 980, the upper transfer medium 917 may be collected by an upper collector 997 and the lower transfer medium 927 may be collected by a lower collector 998. The imaged substrate 940 may be separated from the transfer media 917 and 927 and collected as well via collector or simply conveyed to a storage or transportation container.

Figure 9B:
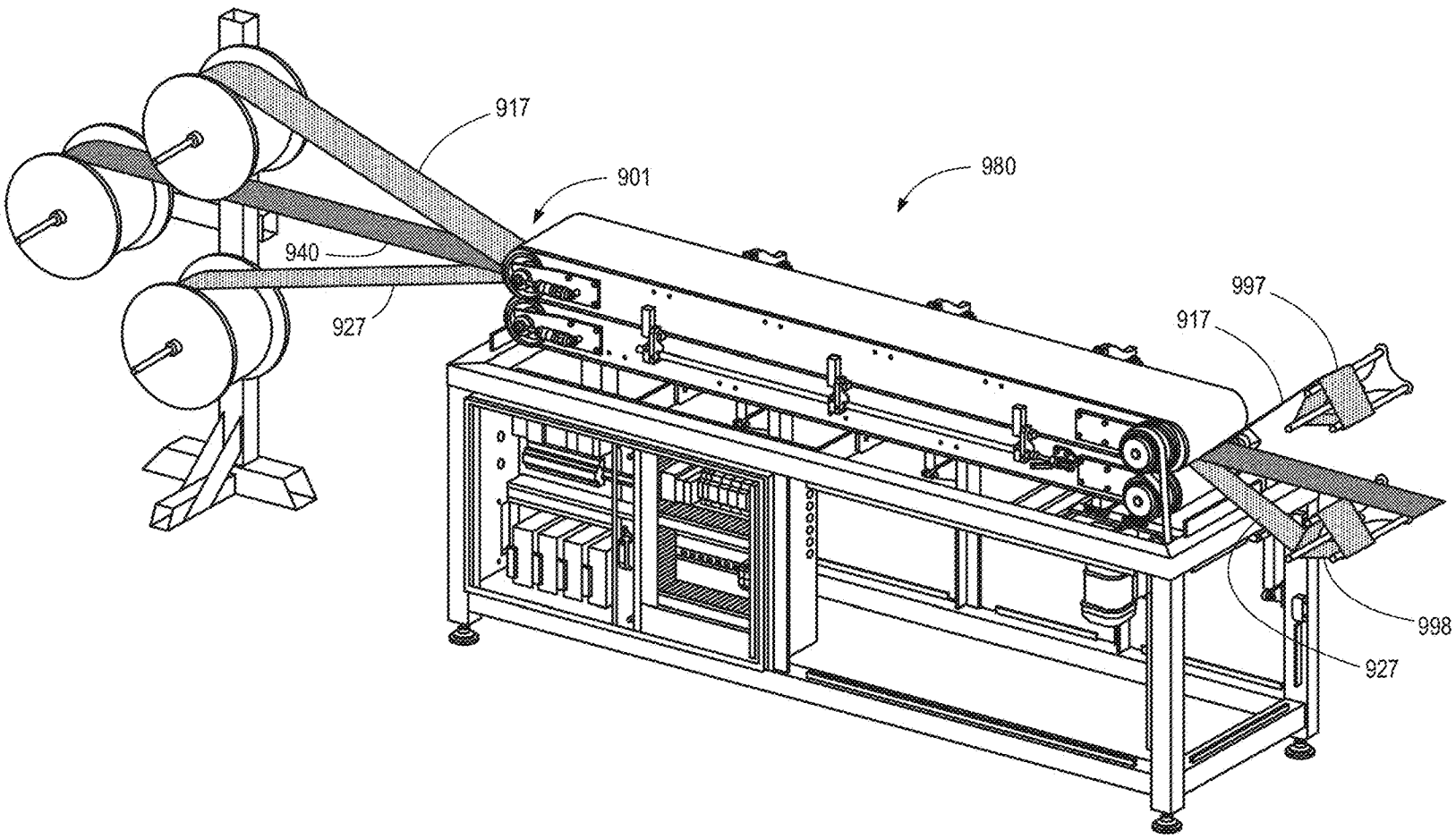
FIG. 9B illustrates an embodiment in which transfer media is pre-printed on rolls and can be transferred using a sublimation method, hot transfer, or other transfer method via heat and/or pressure applied within a thermal press assembly.

FIG. 9B illustrates an alternative embodiment in which transfer media 917 and 927 are unrolled from large, pre-printed spools. The pre-printed spools may be offset printed with images that can be transferred to the substrate 940. In some embodiments, the image may be transferred via thermal sublimation within the thermal press assembly 980. In other embodiments, the images may be transferred via pressure and/or heat within the press assembly 980 via a hot transfer process/reaction or some other non-sublimation process. As illustrated, the transfer media may be any width and, as previously described, wide transfer media may be used to accommodate a wide substrate and/or multiple narrow substrates.

FIGS. 10-14 illustrate specific embodiments of pressing assemblies and associated components 1080-1480 that have been configured for thermal sublimation in a continuous-feed arrangement. It is appreciated that in many instances, the same embodiment or a slight variation thereof may be used for other processes in addition to sublimation thermal image transfers. For instance, the illustrated embodiments may be suitable for laminating or other thermal pressing processes such as pleating, fusing, and curing.

Figure 10:
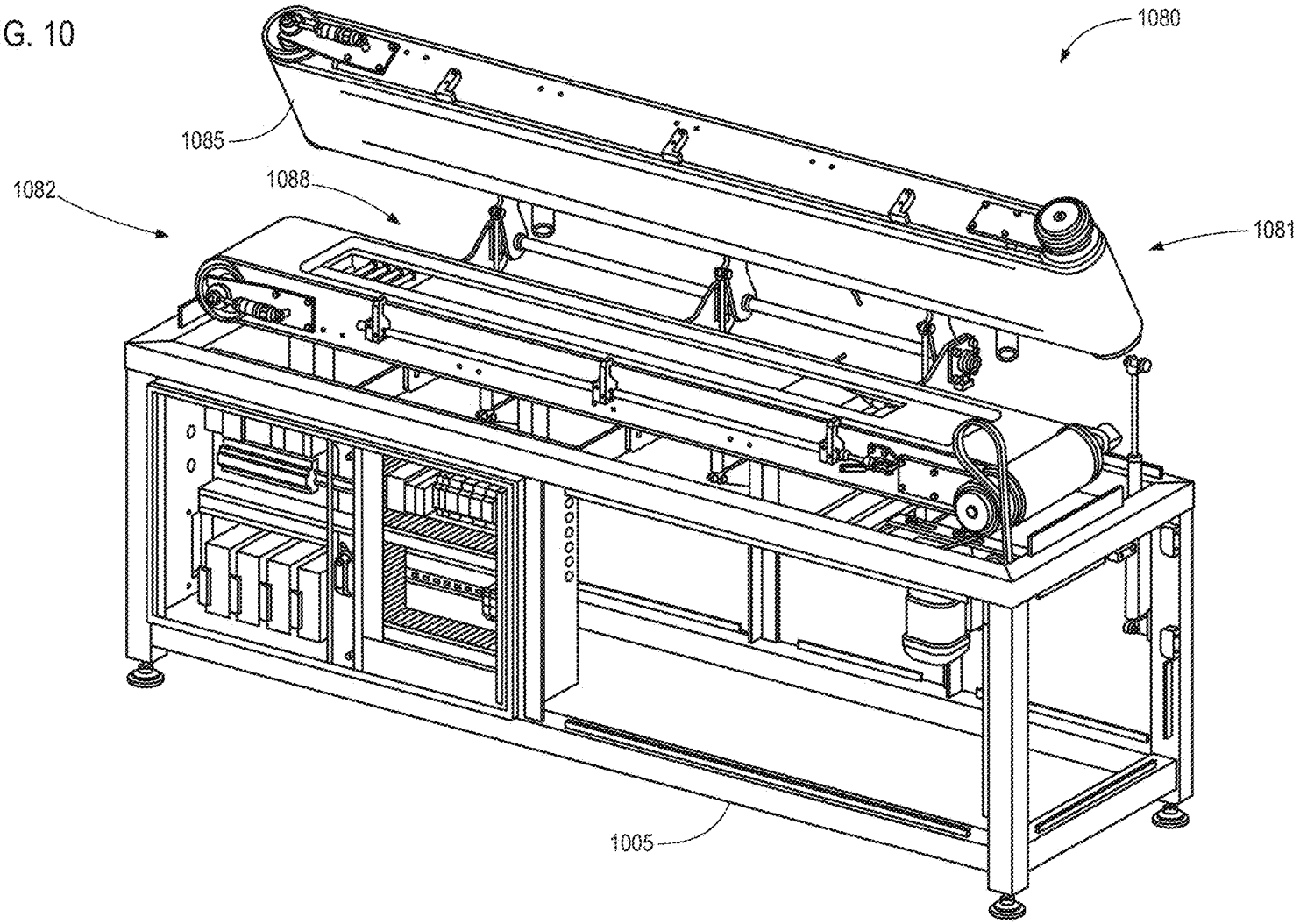
FIG. 10 illustrates a press assembly with a top section raised and an advancing belt removed from the lower section, according to various embodiments.

With reference to sublimation embodiments, FIG. 10 illustrates a sublimation assembly 1080 with an upper assembly 1081 raised and a lower advancing belt removed (corresponding to upper advancing belt 1085) from a lower assembly 1082, according to various embodiments. In various embodiments, the sublimation assembly 1080 may be mounted on a platform or stand 1005. In such embodiments, various control systems, pneumatic systems, vacuum systems, etc. may be housed within the stand 1005.

In various embodiments, upper 1085 and lower (not shown) belts may advance a substrate along the length (longitudinal axis) of the sublimation assembly 1080. As described herein, the substrate may be interposed between transfer media for two-sided image transfer. In single-sided image transfers, the substrate may pass through the sublimation assembly 1080 with only a single layer of transfer media. In such an embodiment, a protective medium may be pulled directly from a roll for protecting the side of the substrate that is not being processed.

Heat and/or pressure may be applied to the substrate as it passes through the sublimation assembly 1080 to induce thermal sublimation of an ink, dye, etc. from the transfer media into the substrate. The heat and/or pressure may originate from an environmentally controlled chamber 1088 underlying each of the upper advancing belt 1085 and the lower advancing belt (removed to show the interior of the environmentally controlled chamber 1088). In various embodiments, the upper assembly 1081 and the lower assembly 1082 are mirror images of one another and thus the components or operations described or illustrated with respect to one of the assemblies are applicable to the other assembly.

It is contemplated that in some embodiments a single-sided image transfer device may have an upper or lower assembly that does not include an environmentally controlled chamber 1088. For instance one of the assemblies may simply facilitate the advancement of the substrate (and optionally one or more transfer media layers).

In the illustrated embodiment, the upper assembly 1081 is shown pivoting with respect to the lower assembly 1082. In other embodiments, the upper and lower assemblies may be semi-permanently secured relative to one another (e.g., bolted in place) such that the movement of one of the assemblies relative to the other would require partial disassembly. In still other embodiments, the assemblies may be configured to selectively move apart from each other vertically for maintenance, to clear jams, and/or to accommodate substrates and/or transfer media having various thicknesses.

Figure 11:
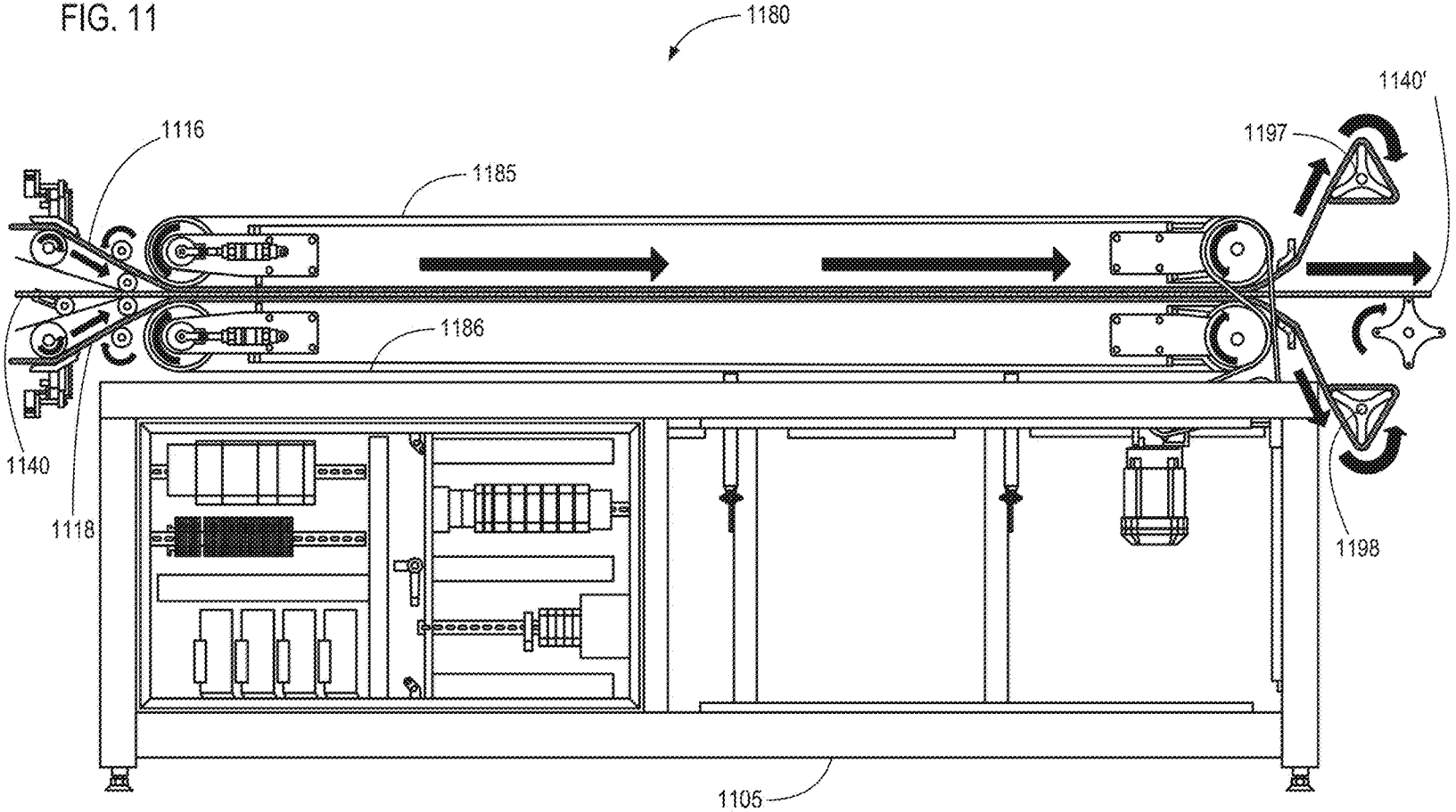
FIG. 11 illustrates a side view of one embodiment of a thermal pressing system.

FIG. 11 illustrates a side view of one embodiment of a sublimation imaging system 1180. As illustrated, a substrate 1140 may be interposed between upper 1116 and lower 1118 transfer media by an alignment assembly (see example embodiments in FIGS. 2-9). The interposed substrate 1140 may be advanced by belts on the upper assembly 1185 and lower assembly 1186 of a sublimation assembly mounted on a stand 1105.

The sublimation assembly (comprising upper 1185 and lower 1186 assemblies) may serve to induce thermal sublimation of an image or images from the transfer media 1116 and 1118 to the substrate 1140 as the interposed substrate 1140 is advanced through the sublimation assembly. Collectors 1197 and 1198 may collect the used transfer media 1116 and 1118 as the imaged substrate 1140' exits the sublimation assembly. In some embodiments, the transfer media may be reused, while in others it is discarded. The imaged substrate 1140' may be collected, stored, and/or shipped as desired. In some embodiments, lengths of the substrate may be cut into sections for subsequent processing.

As previously described, the sublimation imaging system 1180 may be adapted to accommodate a wide range of substrate thicknesses and widths. As the sublimation imaging system 1180 is a continuous (or intermittent) feed system, it may accommodate any length of substrate. In the illustrated embodiment, a relatively narrow substrate 1140

(and imaged substrate 1140') is shown. Such a substrate might be suitable for manufacturing pull ties for zippers, lanyards, eyewear retainers, cords, pull strings, tie strings, and the like.

In other embodiments, the substrate may be sufficiently wide to accommodate both raw materials and/or post-manufactured articles. For instance, the sublimation imaging system 1180 may be configured to thermally transfer images via sublimation to manufactured clothing (e.g., shirts, pants, hats, etc.), towels, bed linens, signage and advertisements, etc. In such instances, the sublimation image transfer may be the final or near final processing step of manufacturing.

In other embodiments, the sublimation imaging system 1180 may be configured to sublimate images into raw materials. For example, in some embodiments the sublimation imaging system 1180 is configured with spools (see, e.g., spools of the substrate feed system 110 in FIG. 1) that can accommodate a 40- or 100-yard bolt of cloth as the substrate. The sublimation imaging system 1180 may be configured to accommodate the width of the bolt of cloth, including standard sizes such as 45", 60", 35-36", 39", 41", 44-45", 50", 52-54", 58-60", 66", 72", 96", and 108".

As previously described, the stand 1105 may house one or more controllers, computer, processors, pneumatic controls, etc. In various embodiments, a user may access a keyboard, mouse, touchscreen, or the like to control any of the components described herein. For example, a controller may be accessible via a touch screen interface that allows a user to customize the sublimation and other processes. More specifically, a user may control one or more of: the overall throughput rate; a desired accuracy (may effect throughput, speed, temperature, etc.); a temperature, pressure, air quality, humidity, gas mixture, and/or other environmental variable; a substrate thickness; a spacing of the upper and lower assemblies of the sublimation assembly; alerts; and/or any other adjustable or controllable aspect of the system. In some embodiments, pre-programmed workflows and profiles may be available and/or customized for specific fabrics, image qualities, dye or ink types, or other configuration settings.

Figure 12:
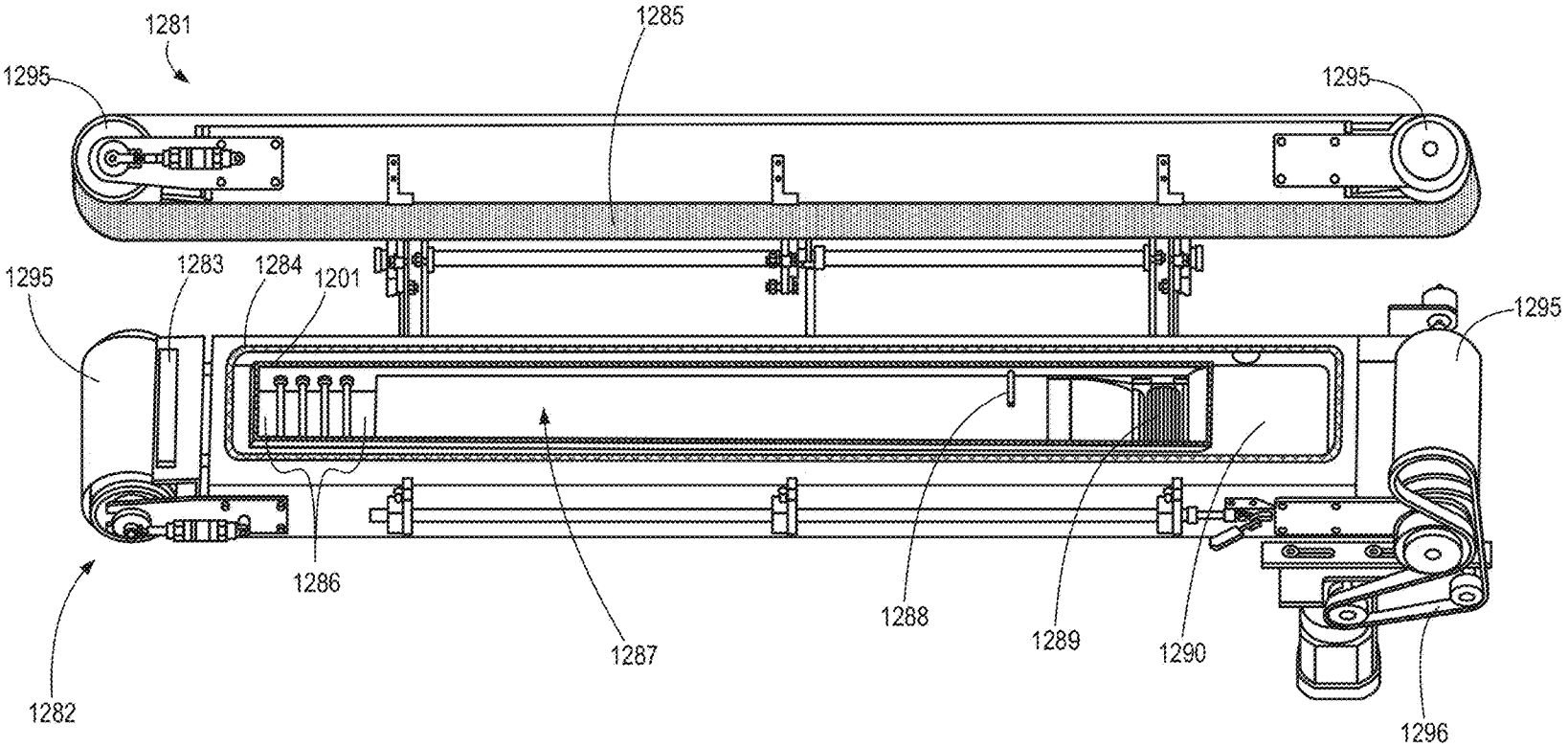
FIG. 12 illustrates a top view of a bottom section of a thermal pressing system with an advancing belt removed, according to one embodiment.

FIG. 12 illustrates a top view of a lower assembly 1282 of a sublimation assembly 1280 with a lower advancing belt removed, according to one embodiment. The upper advancing belt 1285 is shown in place covering the environmentally controlled chamber (defined by seal 1284). As illustrated, the upper belt 1285 and the removed lower belt may be driven by one or more pulleys 1295 and associated gears, motors, etc. In the illustrated embodiment, drive belts 1296 cause pulleys 1295 to rotate, which in turn cause the upper 1285 and lower advancing belts to move.

In various embodiments, the surface of the belt 1285 may be configured to continuously (or intermittently) advance a substrate directly and/or to advance a substrate interposed between transfer media.

FIG. 12 illustrates a pre-confinement zone defined by a confinement member 1283. The confinement member 1283 (acting in concert with a similar confinement member hidden by belt 1285) may apply pressure to a substrate interposed between transfer media. The confinement member 1283 partially confines the movement of the interposed substrate along the length of sublimation assembly 1280. The confinement member 1283 confines the interposed substrate together with the transfer media. Accordingly, the interposed substrate and transfer media are inhibited from moving relative to one another and are generally inhibited from moving laterally (i.e., from front to back or into and out of the illustrated figure) within the sublimation assembly 1280.

In various embodiments, a pre-confinement member and/or pre-confinement zone may comprise a coating on the pulley 1295, such as a rubber or foam coating to exert additional compressive force to confine the substrate and/or transfer media prior to the application of heat.

Notably, the pre-confinement zone and confinement member 1283 are positioned such that the substrate and transfer media are spatially confined prior to heating. In various embodiments, this ensures that sublimation and the associated image transfer from the transfer media to the substrate does not begin before the substrate and transfer media are in a fixed position relative to one another. Any movement of the substrate relative to the transfer media after sublimation has begun may result in blurry or lower resolution image transfer. Accordingly, positioning the pre-confinement zone and confinement member 1283 prior to the heat zone potentially increases the resolution of the image transfer.

Following confinement, the transfer media and interposed substrate may enter a heat zone within an environmentally controlled chamber. An environmental seal 1284 may define a zone within which one or more environmental variables are controlled. In the illustrated embodiment, the environmental seal 1284 defines a rectangular environmentally controlled chamber as a cavity underlying an advancing belt (the removed belt corresponding to advancing belt 1285). Thus, the belt (not shown) may act as a lid or upper surface of the environmentally controlled chamber defined by environmental seal 1284.

In other embodiments, seal 1284 may be a layer substantially covering the entire cavity, in which case the belt (not shown) would advance over the seal. In such embodiments, the top layer seal might be lubricated with a petroleum- or graphite-based lubricant to reduce friction, and/or the belt may be sufficiently tensioned to create a gap between the lower surface of the belt and the upper seal layer.

Returning to the illustrated embodiment, the environmental seal 1284 may be pneumatically pressurized to create a seal against the belt. The environmental seal 1284 may be lubricated to allow the belt to advance without breaking the seal between the environmental seal 1284 and the belt. In such embodiments, the pressure used to inflate the environmental seal 1284 may be controlled to select a desired pressure within the cavity of the environmentally controlled chamber.

For example, the environmental seal 1284 may support a positive pressure between 0 PSI and 5 PSI. The environmentally controlled chamber may then be pressurized to a desired pressure based on the pressure used in the environmental seal 1284. R is noteworthy that the pressure in the environmental seal 1284 does no necessarily need to be equal to the pressure within the environmental chamber. The pressure within the environmental chambers of the lower assembly 1282 and the upper assembly 1281 may cause the upper 1285 and lower advancing belts to slightly compress the transfer media and interposed substrate as they pass through.

The amount of compression, if any, can be controlled based on the pressure within the environmentally controlled chamber, the pressure of the environmental seal 1284, the tension of the advancing belts, and the material used in the advancing belts. In one embodiment, the advancing belts comprise a glass-reinforced Teflon high-temperature belt. In some embodiments, depending on the width of the belts and the expected amount of steam produced during sublimation, the advancing belts, such as belt 1285, may have exhaust grooves or exhaust apertures, and/or may include a material, such as felt, on one or more edges to prevent the edges of the upper 1285 and lower advancing belts from forming a seal.

The environmentally controlled chamber may allow one or more environmental variables to be adjusted based on a particular application. For example, the environmentally controlled chamber may allow for the adjustment of a temperature, a pressure, an air particle count, a humidity level, and a gaseous mixture.

A heat chamber may define a heat zone and be disposed within the environmentally controlled chamber. The heat chamber may be defined by a heat seal 1201. Heat seal 1201 may, for example, comprise a fabric or other gas-permeable seal configured to reduce heat transfer without significantly impacting pressure. A first stage of the heat zone defined by the heat seal 1201 may include one or more preheating elements 1286. In one embodiment, the preheating elements 1286 include between two and eight preheating elements rated between 100 and 1000 watts each. An alternative number of preheating elements 1286 may be utilized and/or higher or lower power consumption may be employed. The preheating elements 1286 may be of any of a wide variety of heater types, including infrared heaters.

Preheating elements 1286 may be configured to quickly increase the temperature of the substrate and transfer media to levels at which sublimation of the ink or dye begins. The exact temperature may depend on the substrate material being used, the transfer media being used, the desired amount of transfer, and/or the composition of the ink, dye, paint, stain, or similar material.

A temperature sensor 1288 may monitor a temperature within the rest of heat chamber within the heat zone (optionally referred to as a saturation heat zone) to maintain a temperature that will effectuate the desired sublimation profile as the substrate passes through the sublimation assembly 1280. In some embodiments, one or more additional heat elements (not shown) may be employed anywhere within the heat chamber and can be turned on and off as needed to maintain a desired temperature. In some embodiments, a temperature between 325 and 475 degrees Fahrenheit may be sufficient to cause sublimation and result in a quality image transfer. In various embodiments, the temperature selected may also be at least partially based on the speed at which the substrate is conveyed through the sublimation assembly 1280 by the upper 1285 and lower belts.

In some embodiments, these supplemental heating elements may be positioned beneath a divider 1287 (compare divider 1387 of FIG. 13) that divides the heat chamber into an upper portion and a lower portion. In such an embodiment, the divider 1287 may serve as a heat deflector to maintain a uniform temperature throughout the heat chamber.

In various embodiments, a fan 1289, such as a cylindrical fan, may be used to circulate air around the divider 1287 to maintain a uniform air temperature. In some embodiments, sublimation may be effectuated using a series of hot and cold spots. In such an embodiment, a series of heaters may be spaced apart from one another along the length of the heat chamber.

Once the image has been sufficiently transferred via thermal sublimation, the transfer media and interposed substrate may still be hot, and residual sublimation, perhaps at a slower rate, may continue until the temperature falls below the sublimation threshold. Accordingly, if the transfer media are separated or otherwise moved with respect to the substrate before the temperature has dropped sufficiently to halt sublimation, the image quality may suffer. For instance the residual sublimation may result in "ghost" images if the substrate is shifted relative to the transfer media.

For at least this reason, a post-sublimation cooling zone 1290 may be disposed within the environmentally controlled chamber. The environmentally controlled chamber ensures that the substrate remains spatially fixed with respect to the transfer media while they cool to a temperature below the sublimation threshold. The post-sublimation cooling zone 1290 may cool the substrate and/or transfer media to a temperature below a sublimation threshold, such as 225 degrees Fahrenheit for some applications.

In some embodiments, a tack paper or other adhesive may be used to further ensure that the transfer media and the substrate are spatially confined relative to one another. Heat seal 1201 allows the post-sublimation cooling zone 1290 to remain significantly cooler than the heat zone in which preheating elements 1286 are disposed.

Figure 13:
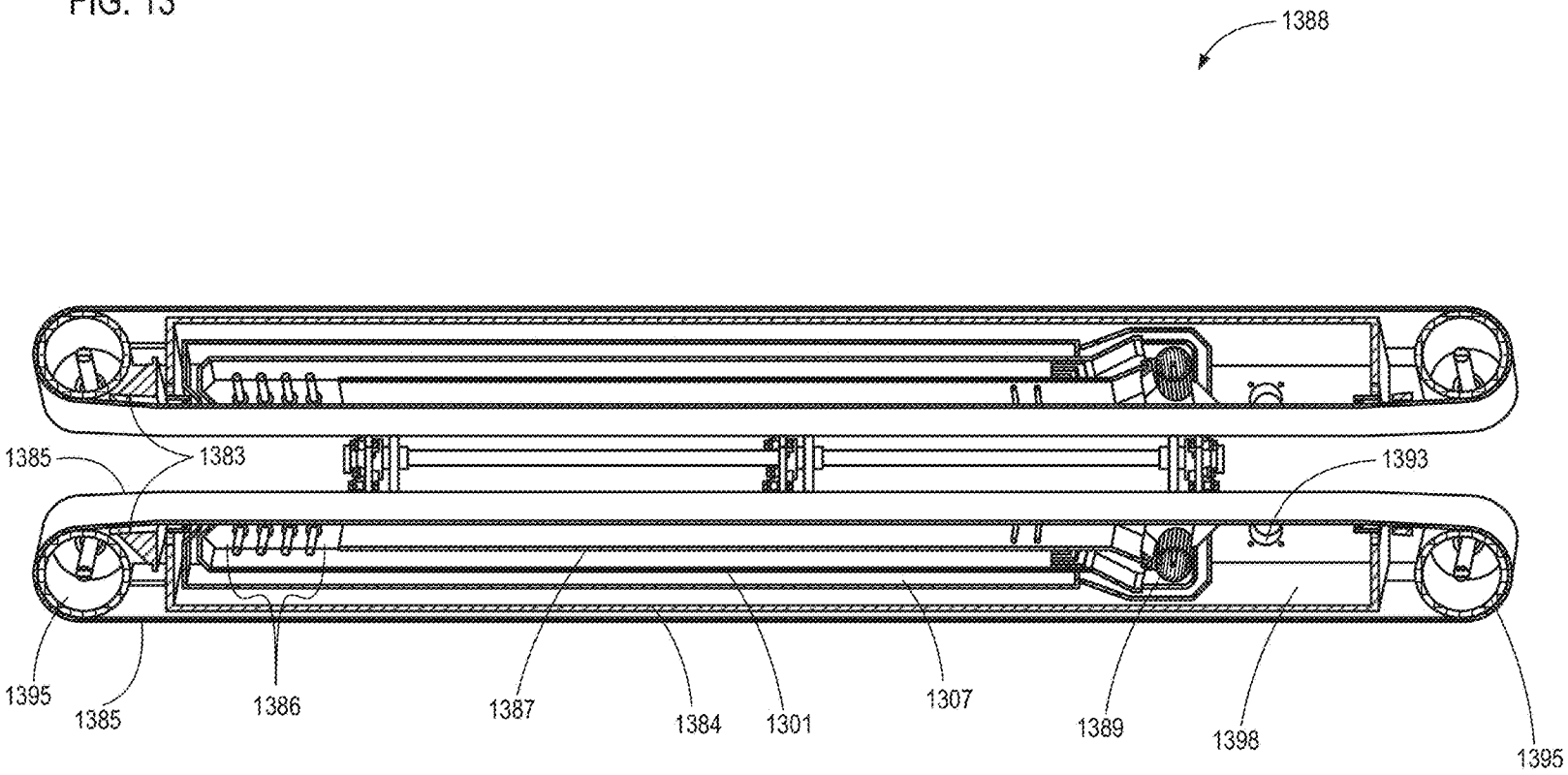
FIG. 13 illustrates a cutaway view of a thermal pressing system, according to one embodiment.

FIG. 13 illustrates a cutaway view of a sublimation imaging system 1388, according to one embodiment. As illustrated, an advancement belt 1385 may be advanced by pulleys 1395. Pre-confinement members 1383 may be used to spatially confine a substrate relative to transfer media and/or relative to the width of the belt 1385.

Preheating elements 1386 are illustrated as a first stage of a heating zone within a heat chamber defined by perimeter 1301. A divider 1387 may divide the heat chamber, and a fan 1389 may circulate heated air within the heat chamber, such as within a thermal sublimation zone of the heat chamber. More generally, the fan may circulate the heat within a thermal reaction zone of the heat chamber. A post-sublimation cooling zone 1398 may allow the heated substrate to cool below a sublimation threshold prior to the substrate being spatially moved relative to the transfer media.

The post-sublimation cooling zone 1398 and the heat chamber defined by perimeter 1301 may be disposed within an environmentally controlled chamber defined by perimeter 1384. Perimeter 1384 may include an upper seal extending substantially parallel to the belt 1385. Alternatively, perimeter 1384 may include a pneumatically controlled seal around an upper perimeter that contacts and uses the belt 1385 as an upper boundary for the environmentally controlled chamber.

In some embodiments, one or more exhaust, vacuum, or air supply ports may be utilized to control the temperature, pressure, air quality, humidity, gas mixture, and/or other environmental variables within the environmentally controlled chamber. In the illustrated embodiment, a port 1393 may be used to supply cold air to the post-sublimation cooling zone 1398. Other ports (not shown) may be used, for example, to maintain a desired temperature and/or pressure within the environmentally controlled chamber.

In some embodiments, including the illustrated embodiment, a thermally isolating layer 1307 may separate the outer perimeter 1301 of the heat chamber from the outside region of the environmentally controlled chamber defined by outer perimeter 1384.

As previously stated, the presently described system may be used for any of a wide variety of purposes that involve thermal pressing, and not just thermal sublimation image transfers. In such embodiments, more generalized terms may be used to describe the functionality of each of the various components described above. Using FIG. 13 to reference such alternative embodiments, FIG. 13 may be said to show a cutaway view of a thermal pressing system 1388, according to a general embodiment. An advancement belt 1385 may be advanced by pulleys 1395. Pre-confinement members 1383 may be used to spatially confine a substrate and/or transfer media relative to each other and/or relative to the width of the belt 1385.

Preheating elements 1386 are illustrated as a first stage of a heating zone within a heat chamber defined by perimeter 1301. A divider 1387 may divide the heat chamber, and a fan 1389 may circulate heated air within the heat chamber. A post-reaction (or post-processing) cooling zone 1398 may allow the heated substrate to cool below a threshold prior to the substrate becoming unconfined.

The post-reaction cooling zone 1398 and the heat chamber defined by perimeter 1301 may be disposed within an environmentally controlled chamber defined by perimeter 1384. Perimeter 1384 may include an upper seal extending substantially parallel to the belt 1385. Alternatively, perimeter 1384 may include a pneumatically controlled seal around an upper perimeter that contacts and uses the belt 1385 as an upper boundary for the environmentally controlled chamber.

In some embodiments, one or more exhaust, vacuum, or air supply ports may be utilized to control the temperature, pressure, air quality, humidity, gas mixture, and/or other environmental variables within the environmentally controlled chamber. In the illustrated embodiment, a port 1393 may be used to supply cold air to the post-reaction cooling zone 1398. Other ports (not shown) may be used, for example, to maintain a desired temperature and/or pressure within the environmentally controlled chamber.

In some embodiments, including the illustrated embodiment, a thermally isolating layer 1307 may separate the outer perimeter 1301 of the heat chamber from the outside region of the environmentally controlled chamber defined by outer perimeter 1384.

Figure 14:
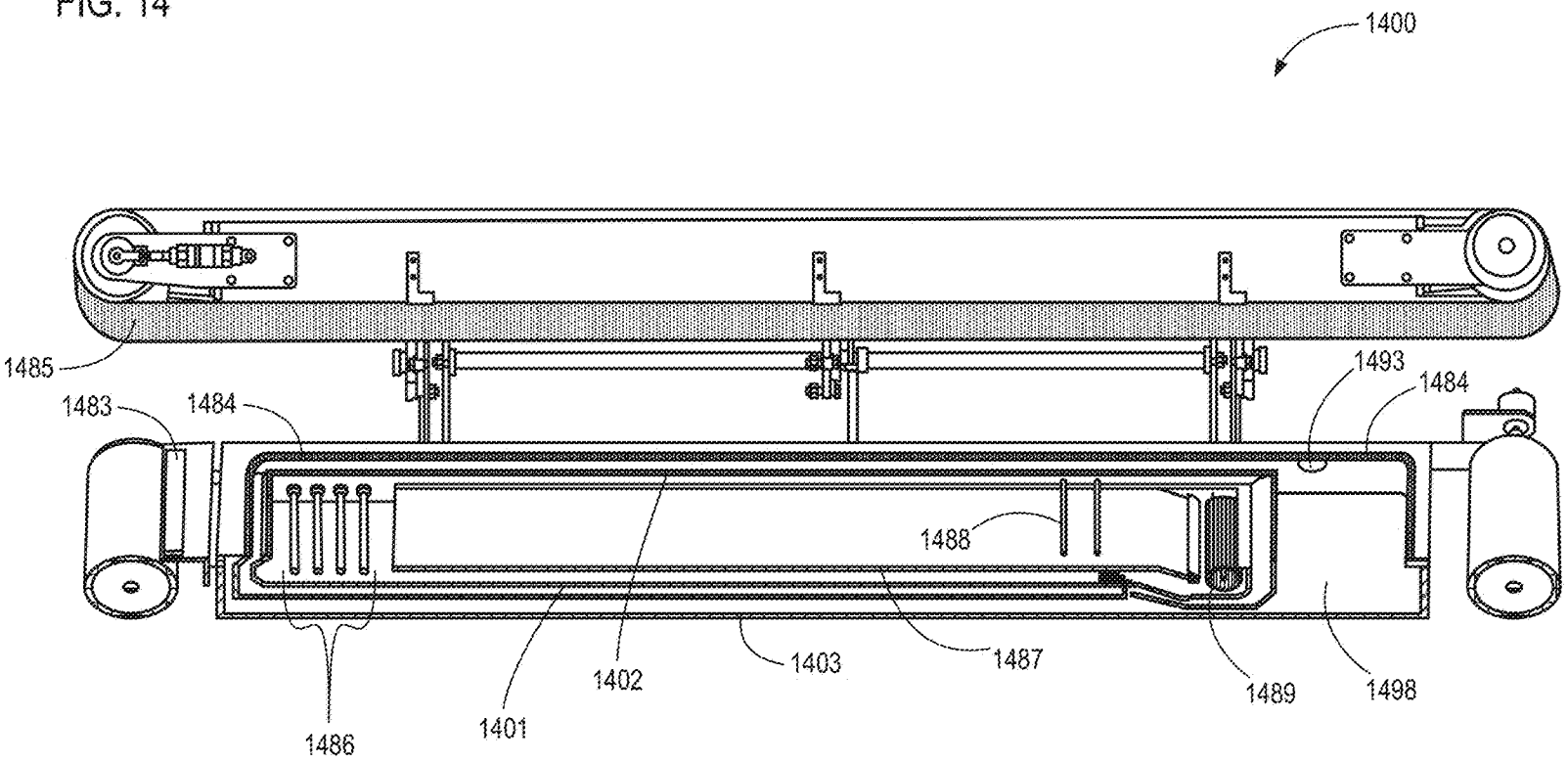
FIG. 14 illustrates an upper perspective view of a thermal pressing system with an advancing belt removed, according to one embodiment.

FIG. 14 illustrates an upper perspective view of a sublimation imaging system 1400 with an advancing belt removed and a front side shown in cutaway, according to one embodiment. Preheating elements 1486 are illustrated as a first stage of a heating zone within a heat chamber defined by perimeter 1401 and a heat seal 1402. A divider 1487 may divide the heat chamber, and a fan 1489 may circulate heated air within the heat chamber. Environmental probes 1488 may be configured to monitor the temperature, pressure, air quality, humidity, gas mixture, and/or other environmental variables within the environmentally controlled chamber. A post-sublimation cooling zone 1498 may allow the heated substrate to cool below a threshold (e.g., a sublimation threshold, lamination threshold, curing threshold, etc.) prior to the substrate being spatially moved relative to the transfer media and/or relative to the advancement belts.

The post-sublimation cooling zone 1498 (or more generally the post pressing sublimation cooling zone 1498) and the heat chamber defined by perimeter 1401 and heat seal 1402 may be disposed within an environmentally controlled chamber defined by perimeter 1403 and heat environmental seal 1484. Perimeter 1403 may include an upper seal extending substantially parallel to the belt 1485. Alternatively and as illustrated, perimeter 1403 may include a pneumatically controlled seal 1484 around an upper perimeter that contacts the belt 1485 and uses the belt 1485 as an upper boundary for the environmentally controlled chamber.

In some embodiments, one or more exhaust, vacuum, or air supply ports, such as port 1493, may be utilized to control the temperature, pressure, air quality, humidity, gas mixture, and/or other environmental variables within the environmentally controlled chamber. For example, air may be supplied via port 1493 to maintain a desired temperature and/or pressure within the cooling zone 1498 of the environmentally controlled chamber. In some embodiments, not illustrated, the cooling zone 1498 and the heat zone may be housed in independent environmentally controlled chambers, such that different environmental variables may be obtained for each.

Figure 15A:
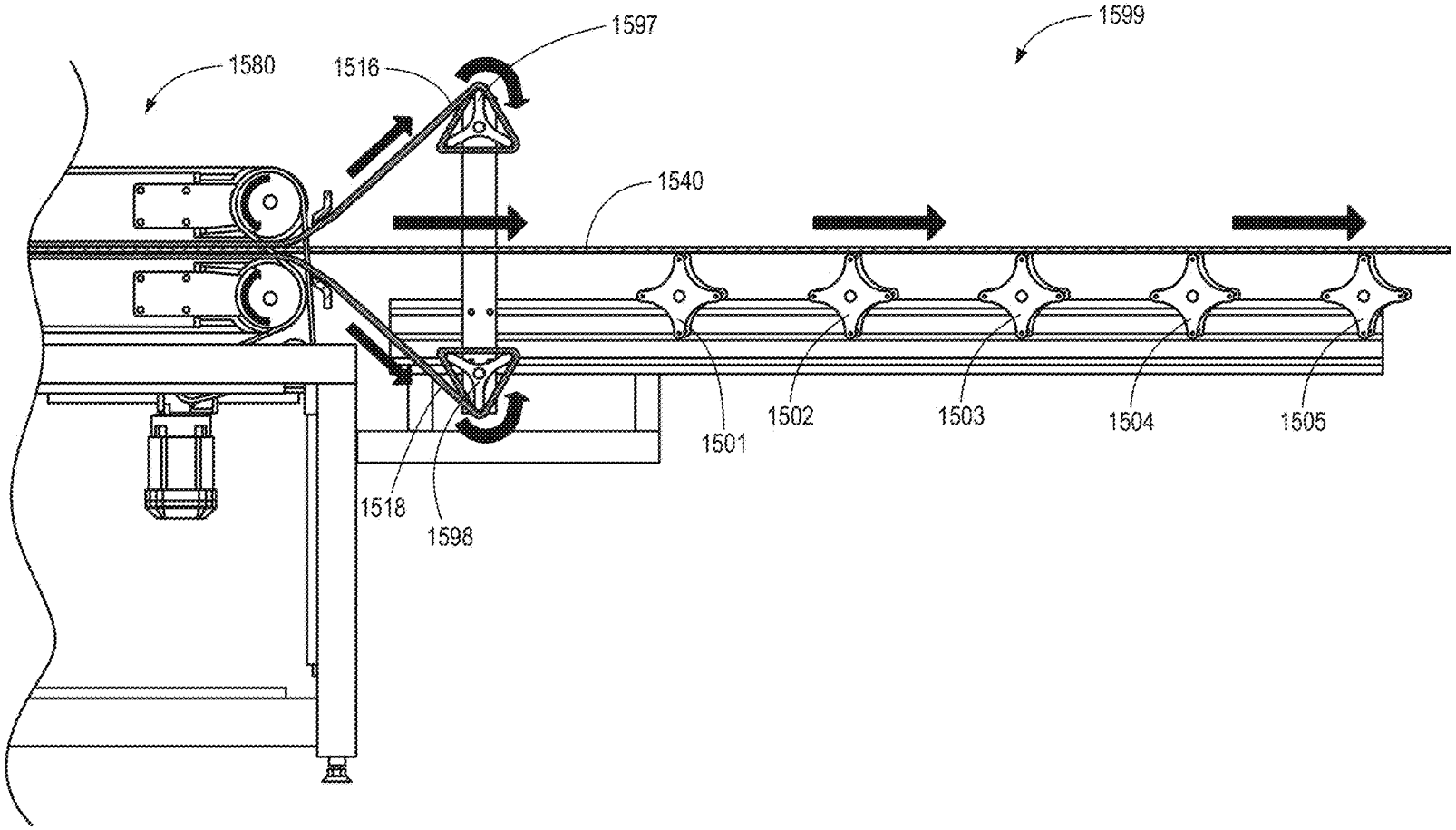
FIG. 15A illustrates a post-pressing media and substrate collection system, according to one embodiment.

FIG. 15A illustrates a post-processing (e.g., post-sublimation) media and substrate collection system 1599, according to one embodiment. In the illustrated embodiment, after substrate 1540 has been processed (e.g., imaged via thermal sublimation within sublimation assembly 1580) and cooled to a temperature below a threshold value with a post-processing cooling zone, the used transfer media 1516 and 1518 may be collected by collectors 1597 and 1598, respectively. The substrate 1540 may be guided by one or more collectors 1501, 1502, 1503, 1504, and 1505 to a supply bin, a box, a shipping container, a post-imaging manufacturing area, and/or another location.

Figure 15B:
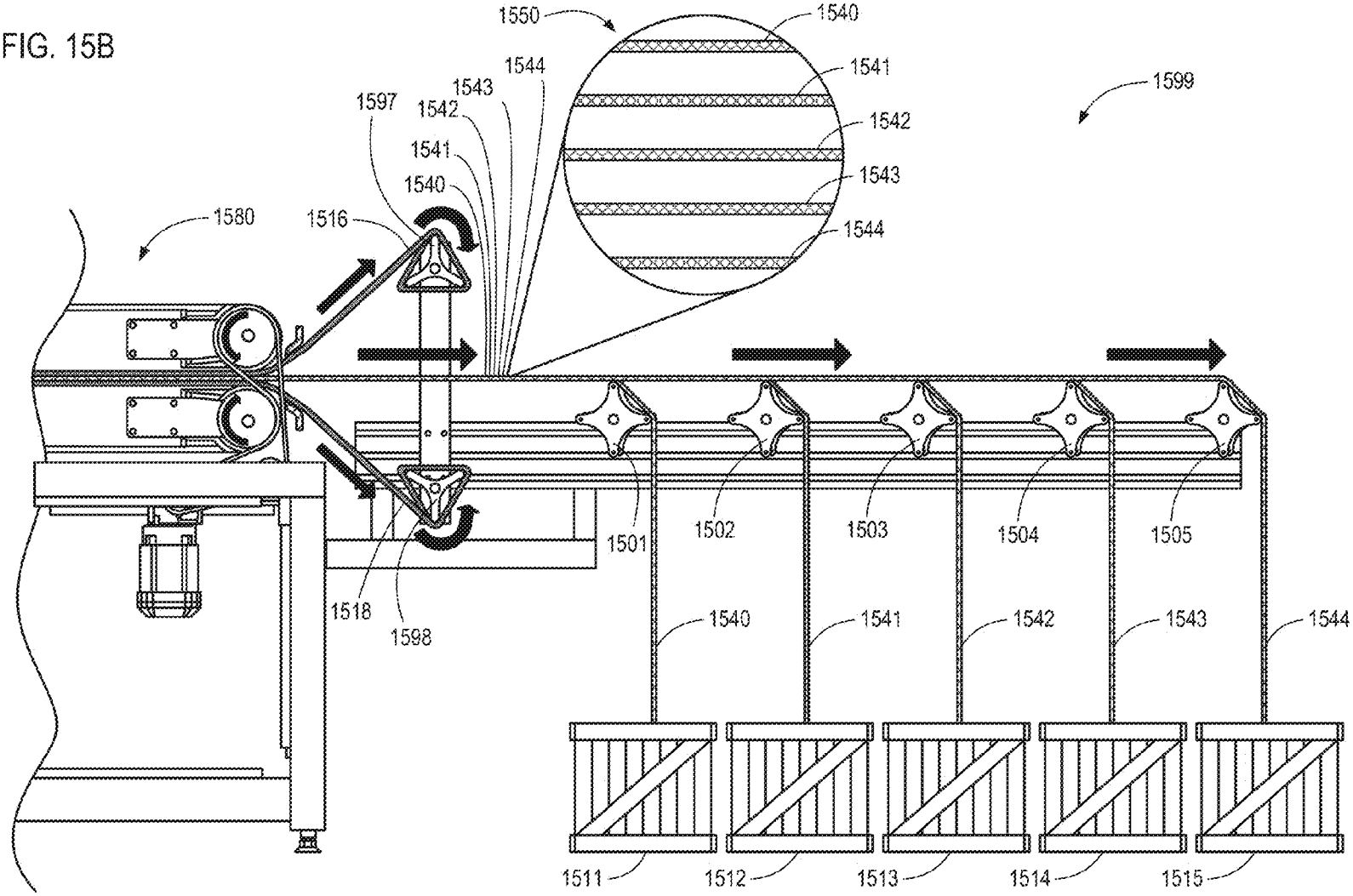
FIG. 15B illustrates another view of a post-pressing media and substrate collection system, according to one embodiment.

FIG. 15B illustrates another view of a post-processing media and substrate collection system 1599, according to one embodiment. In the illustrated embodiment, five lengths of substrate 1540, 1541, 1542, 1543, and 1544 are thermally sublimated (or otherwise processed) at the same time. Each of the lengths of substrate 1540-1544 may be interposed between upper and lower transfer media sections. Alternatively, a single upper transfer medium 1516 and single lower transfer medium 1518 may be wide enough to interpose all five lengths of substrate 1540-1544.

In such an embodiment, the transfer media 1516 and 1518 may be printed with the same image across their widths such that all five substrates 1540-1544 are imaged with the same image on top and on bottom. Alternatively, the upper transfer medium 1516 may have a first image to transfer to an upper surface of all five of the substrates 1540-1544 and the lower transfer medium 1518 may have a different image to transfer to a lower surface of all five of the substrates 1540-1544.

In still other embodiments, a transfer medium may have different images across each one-fifth section of the transfer medium, and upper and lower transfer media 1516 and 1518 may have different images, such that each surface of each substrate 1540-1544 may have a unique image thermally sublimated at the same time. With five current substrates 1540-1544 being imaged, collectors 1501, 1502, 1503, 1504, and 1505 may be used to separate the substrates 1540-1544 into unique storage or shipping containers 1511, 1512, 1513, 1514, and 1515.

This disclosure has been made with reference to various exemplary embodiments, including the best mode. However, those skilled in the art will recognize that changes and modifications may be made to the exemplary embodiments without departing from the scope of the present disclosure. While the principles of this disclosure have been shown in various embodiments, many modifications of structure, arrangements, proportions, elements, materials, and components may be adapted for a specific environment and/or operating requirements without departing from the principles and scope of this disclosure. These and other changes or modifications are intended to be included within the scope of the present disclosure.

This disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element.

What is claimed is:

1. A thermal sublimation imaging apparatus, comprising:

an upper sublimation assembly configured to transfer an image from an upper transfer medium to an upper surface of a substrate; and a lower sublimation assembly configured to transfer an image from a lower transfer medium to a lower surface of the substrate, wherein the substrate is configured to be interposed between the upper transfer medium and the lower transfer medium, and wherein each of the upper and lower sublimation assemblies comprises:

a first chamber with an opening into a cavity, the first chamber configured to at least partially control at least one environmental variable;

a continuous advancement belt wrapping around the first chamber and covering the opening, the advancement belt configured to advance at least one of the upper and lower transfer media with the interposed substrate along a first axis of the sublimation imaging apparatus;

an environmental seal extending around at least a portion of the opening in the first chamber to provide a seal between the first chamber and the advancement belt to at least partially control at least one environmental variable within the first chamber;

a heat chamber disposed within the cavity of the first chamber, the heat chamber having an opening into a second cavity covered by at least a portion of the advancement belt, wherein the heat chamber is configured to provide heat through the advancement belt to the transfer media to induce thermal sublimation of an image into the substrate, wherein the heat chamber comprises a divider disposed within the second cavity that at least partially divides the heat chamber between an upper portion and a lower portion, and wherein the heat chamber further comprises at least one fan disposed between the divider and a longitudinal end of the second cavity, the at least one fan being configured to circulate air between the upper portion and the lower portion;

a post-sublimation cooling zone disposed at a longitudinal end of the cavity of the first chamber, the post-sublimation cooling zone configured to at least partially cool the sublimated substrate interposed between the upper transfer medium and the lower transfer medium, wherein the longitudinal end of the cavity of the first chamber is disposed adjacent to the longitudinal end of the second cavity; and a heat seal extending continuously around the opening of the heat chamber, wherein a portion of the heat seal is disposed between the heat chamber and the post-sublimation cooling zone.

2. The apparatus of claim 1, wherein each of the upper and lower sublimation assemblies comprises a pre-confinement assembly configured to confine the substrate interposed between the upper transfer medium and the lower transfer medium prior to the interposed substrate being heated by at least one preheating element.

3. The apparatus of claim 1, wherein the at least one fan is a cylindrical fan.

4. The apparatus of claim 1, wherein the environmental variable comprises at least one of: a temperature, a pressure, an air particle count, a humidity level, and a gaseous mixture.

5. The apparatus of claim 1, wherein the environmental seal comprises a pneumatically pressurized seal.

6. The apparatus of claim 5, wherein the environmental seal is configured to support a positive pressure between approximately 0.5 and 5 pounds per square inch (PSI) within the first chamber.

7. The apparatus of claim 1, wherein the heat chamber is configured to heat the upper and lower transfer media and the interposed substrate to a sublimation-inducing temperature between approximately 325 and 475 degrees Fahrenheit.

8. The apparatus of claim 1, wherein the post-sublimation cooling zone comprises at least one cold-air input configured to receive air.

9. The apparatus of claim 8, wherein air received via the at least one cold-air input provides a positive pressure within the first chamber, and wherein the environmental seal is configured to regulate the positive pressure of the first chamber.

10. The apparatus of claim 1, wherein the heat chamber further comprises at least one heating element disposed at a second longitudinal end of the heat chamber.

11. The apparatus of claim 10, wherein the fan, the divider, and the heating element are coplanar with one another along a longitudinal plane.

12. The apparatus of claim 1, wherein the heat seal comprises a gas-permeable seal.

13. The apparatus of claim 1, wherein the divider comprises a heat deflector.

14. A thermal sublimation imaging apparatus, comprising:

an upper sublimation assembly configured to transfer an image from an upper transfer medium to an upper surface of a substrate; and a lower sublimation assembly configured to transfer an image from a lower transfer medium to a lower surface of the substrate, wherein the substrate is configured to be interposed between the upper transfer medium and the lower transfer medium, and wherein each of the upper and lower sublimation assemblies comprises:

a first chamber with an opening into a cavity, the first chamber configured to at least partially control at least one environmental variable;

a continuous advancement belt wrapping around the first chamber and covering the opening, the advancement belt configured to advance at least one of the upper and lower transfer media with the interposed substrate along a first axis of the sublimation imaging apparatus;

an environmental seal extending around at least a portion of the opening in the first chamber to provide a seal between the first chamber and the advancement belt to at least partially control at least one environmental variable within the first chamber;

a heat chamber disposed within the cavity of the first chamber, the heat chamber having an opening into a second cavity covered by at least a portion of the advancement belt, wherein the heat chamber is configured to provide heat through the advancement belt to the transfer media to induce thermal sublimation of an image into the substrate, wherein the heat chamber comprises a divider disposed within the second cavity that at least partially divides the heat chamber between an upper portion and a lower portion, wherein the heat chamber further comprises one or more heating elements disposed at a first longitudinal end of the heat chamber, and wherein the heat chamber further comprises at least one fan disposed within the second cavity at a second longitudinal end of the heat chamber, the at least one fan being configured to circulate air between the upper portion and the lower portion, wherein the one or more heating elements, the divider, and the fan are coplanar with one another along a longitudinal plane;

a post-sublimation cooling zone disposed within the cavity of the first chamber, the post-sublimation cooling zone configured to at least partially cool the sublimated substrate interposed between the upper transfer medium and the lower transfer medium; and a heat seal extending continuously around the opening of the heat chamber, wherein the heat seal comprises a gas-permeable seal, and wherein a portion of the heat seal is disposed between the heat chamber and the post-sublimation cooling zone.

15. The apparatus of claim 14, wherein the divider comprises a heat deflector.

16. The apparatus of claim 14, wherein each of the upper and lower sublimation assemblies comprises a pre-confinement assembly configured to confine the substrate interposed between the upper transfer medium and the lower transfer medium prior to the interposed substrate being heated by at least one preheating element.

17. The apparatus of claim 14, wherein the at least one fan is a cylindrical fan.

18. The apparatus of claim 14, wherein the environmental variable comprises at least one of: a temperature, a pressure, an air particle count, a humidity level, and a gaseous mixture.

19. The apparatus of claim 14, wherein the environmental seal comprises a pneumatically pressurized seal.

20. The apparatus of claim 14, wherein the heat chamber is configured to heat the upper and lower transfer media and the interposed substrate to a sublimation-inducing temperature between approximately 325 and 475 degrees Fahrenheit.

* * * * *